US009555964B2

(12) United States Patent
Newkirk et al.

(10) Patent No.: US 9,555,964 B2
(45) Date of Patent: Jan. 31, 2017

(54) MATERIAL HANDLING SYSTEM

(71) Applicant: MYTMULE, LLC, Lincoln, NE (US)

(72) Inventors: Robert Scott Newkirk, Sun City, AZ (US); Dean Alan Prochnow, Lincoln, NE (US); Ryan Andrew Marsh, Crete, NE (US)

(73) Assignee: MYTMULE, LLC, Lincoln, NE (US)

( * ) Notice: Subject to any disclaimer, the term of this patent is extended or adjusted under 35 U.S.C. 154(b) by 0 days.

(21) Appl. No.: 14/696,143

(22) Filed: Apr. 24, 2015

(65) Prior Publication Data

US 2015/0307275 A1 Oct. 29, 2015

Related U.S. Application Data

(60) Provisional application No. 61/983,912, filed on Apr. 24, 2014.

(51) Int. Cl.
*B65F 3/20* (2006.01)
*B65F 3/04* (2006.01)
(Continued)

(52) U.S. Cl.
CPC ..... *B65F 3/205* (2013.01); *B65F 3/041* (2013.01); *B65F 3/208* (2013.01); *B65F 3/143* (2013.01);
(Continued)

(58) Field of Classification Search
CPC ..... B65F 3/205; B65F 3/041; B65F 3/208; B65F 3/14; B65F 3/143; B65F 3/26; B65F 2003/023; B65F 2003/0276; B65F 2003/025
See application file for complete search history.

(56) References Cited

U.S. PATENT DOCUMENTS 3,325,024 A * 6/1967 Shubin ..... B60P 1/50 100/295
3,490,631 A * 1/1970 Smith ..... B65F 3/143 100/100
(Continued)

FOREIGN PATENT DOCUMENTS

DE 19537652 A1 * 4/1997 ..... B65F 3/143
FI EP 1067064 A1 * 1/2001 ..... B65F 3/041

*Primary Examiner* — Glenn Myers
(74) *Attorney, Agent, or Firm* — Craig R. Miles; CR MILES P.C.

(57) ABSTRACT

A material handling system including a receptacle; a loading opening disposed within the receptacle; a transfer opening disposed within the receptacle in adjacent angled relation to the loading opening; and a first compaction plate rotatably coupled proximate the receptacle between the loading opening and the transfer opening. As to particular embodiments, the material handling system can further include a second compaction plate movably disposed proximate the transfer opening. Upon rotation of the first compaction plate toward the second compaction plate in an immovable condition, material disposed between the first and second compaction plates is compacted to generate compacted material. As to particular embodiments, the material handling system can further include a rotatable arm and a rotatable gripper rotatably coupled to a rotatable arm first end. As to particular embodiments, the rotatable arm can be rotatably coupled to an extendable arm which can reversibly extend laterally outward.

19 Claims, 21 Drawing Sheets

(51) Int. Cl.
*B65F 3/14* (2006.01)
*B65F 3/26* (2006.01)
*B65F 3/02* (2006.01)

(52) U.S. Cl.
CPC ..... *B65F 3/26* (2013.01); *B65F 2003/023* (2013.01); *B65F 2003/0276* (2013.01)

(56) References Cited

U.S. PATENT DOCUMENTS

| | | | | | |
|---|---|---|---|---|---|
| 3,542,225 | A * | 11/1970 | Knight | B60P 1/30 | 414/493 |
| 3,643,824 | A * | 2/1972 | Partridge | B65F 3/26 | 100/232 |
| 3,908,848 | A * | 9/1975 | Brewer | B65F 3/26 | 193/4 |
| 4,005,789 | A * | 2/1977 | Gladwin | B65F 3/24 | 414/517 |
| 4,892,454 | A * | 1/1990 | Behling | B65F 3/207 | 100/233 |
| 5,324,161 | A * | 6/1994 | Thobe | B65F 3/208 | 100/233 |
| 5,755,547 | A * | 5/1998 | Flerchinger | B65F 3/046 | 414/408 |
| 2005/0135910 | A1 * | 6/2005 | Pruteanu | B65F 3/201 | 414/517 |

* cited by examiner

1/46/50/66

1/46/50/66

1/47/66

1/37/46/66

1/37/46/66

1/37/46/67

MATERIAL HANDLING SYSTEM

This U.S. Non-Provisional Patent Application claims the benefit of U.S. Provisional Patent Application No. 61/983,912, filed Apr. 24, 2014, hereby incorporated by reference herein.

I. SUMMARY OF THE INVENTION

A broad object of a particular embodiment of the invention can be to provide a material handling system including a receptacle; a loading opening disposed within the receptacle; a transfer opening disposed within the receptacle in adjacent angled relation to the loading opening; and a first compaction plate rotatably coupled proximate the receptacle between the loading opening and the transfer opening.

Another broad object of a particular embodiment of the invention can be to provide a material handling system further including a second compaction plate movably disposed proximate the transfer opening. Upon rotation of the first compaction plate toward the second compaction plate in an immovable condition, material disposed between the first and second compaction plates is compacted to generate compacted material.

Another broad object of a particular embodiment of the invention can be to provide a method of making a material handling system, the method including providing a receptacle; disposing a loading opening within the receptacle; disposing a transfer opening within the receptacle in adjacent angled relation to the loading opening; and rotatably coupling a first compaction plate proximate the receptacle between the loading opening and the transfer opening.

Another broad object of a particular embodiment of the invention can be to provide a method of making a material handling system, the method further including movably disposing a second compaction plate proximate the transfer opening.

Another broad object of a particular embodiment of the invention can be to provide a method of using a material handling system to handle material, the method including obtaining the material handling system; loading the material into the receptacle by passing the material through the loading opening; and compacting the material loaded into the receptacle by rotating the first compaction plate to generate compacted material.

Naturally, further objects of the invention are disclosed throughout other areas of the specification, drawings, and claims.

II. A BRIEF DESCRIPTION OF THE DRAWINGS

Figure 19A:
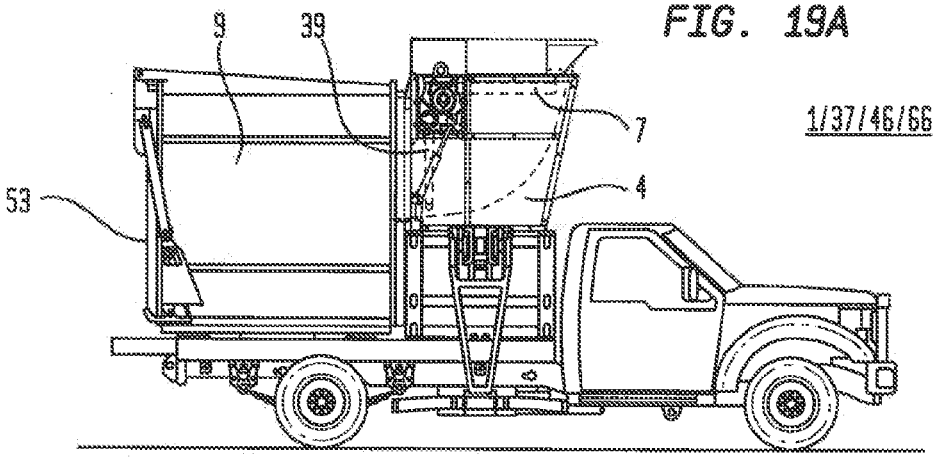
FIG. 19A is a first side view of a particular embodiment of a material handling system, whereby each of a loading opening, a transfer opening, and a container second end opening dispose in a closed condition.
Figure 19B:
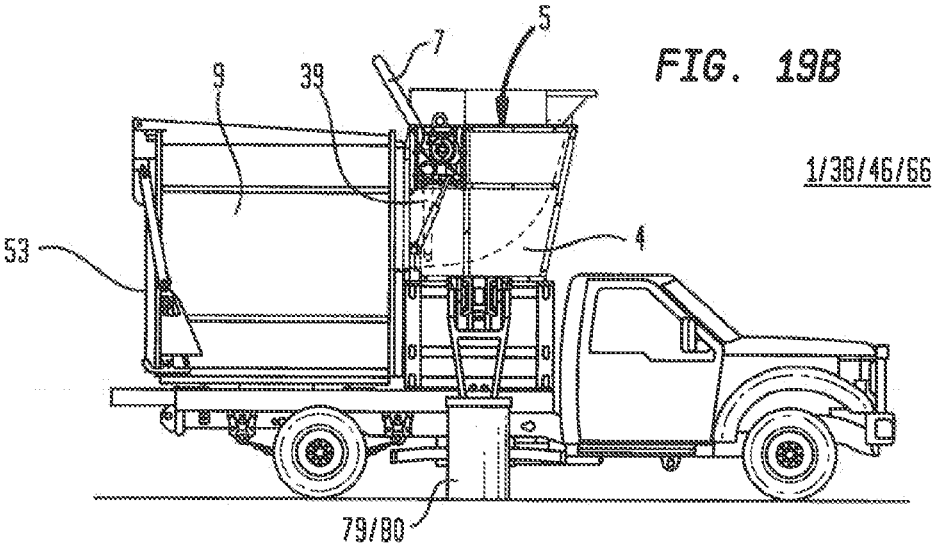
FIG. 19B is a first side view of a particular embodiment of a material handling system, whereby a loading opening disposes in an open condition, each of a transfer opening and a container second end opening dispose in a closed condition, and a rotatable gripper, which couples to a rotatable arm second end of a rotatable arm, releasably grips a vessel containing material.
Figure 19C:
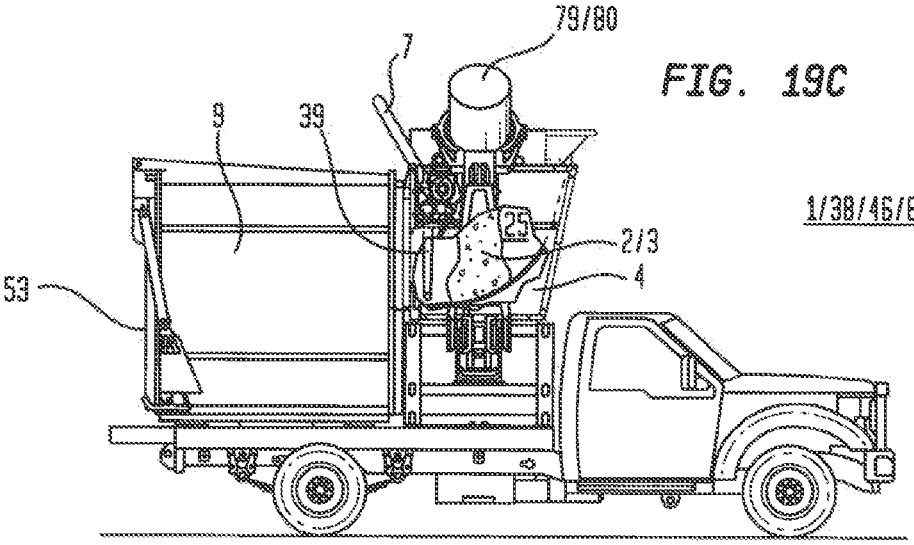

FIG. 19C is a first side view of a particular embodiment of a material handling system, whereby a loading opening disposes in an open condition, each of a transfer opening and a container second end opening dispose in a closed condition, and a vessel, gripped by a rotatable gripper coupled to a rotatable arm second end of a rotatable arm, disposes proximate the loading open to transfer material contained within the vessel into a receptacle.

Figure 19D:
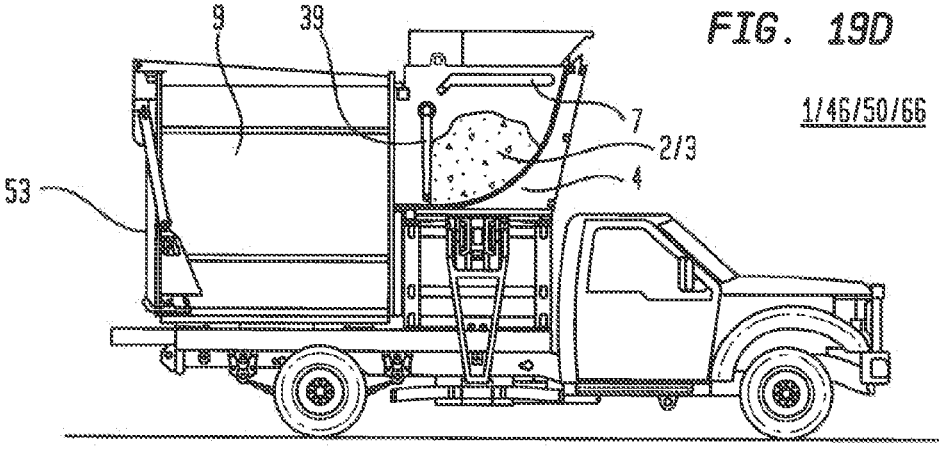

FIG. 19D is a first side view of a particular embodiment of a material handling system, whereby each of a transfer opening and a container second end opening dispose in a closed condition, and a second compaction plate disposes in an immovable condition.

Figure 19E:
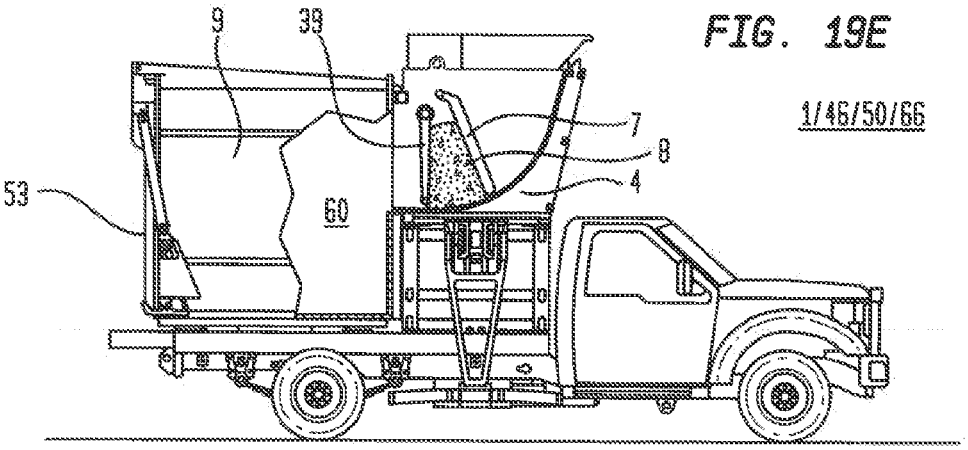

FIG. 19E is a first side view of a particular embodiment of a material handling system, whereby each of a transfer opening and a container second end opening dispose in a closed condition, a second compaction plate disposes in an immovable condition, and a first compaction plate rotates toward the second compaction plate to compact material disposed between the first and second compaction plates.

Figure 19F:
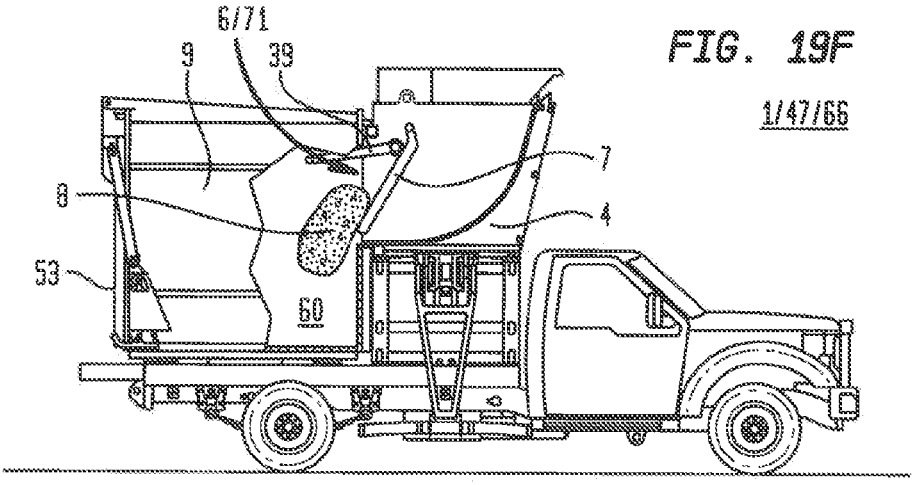

FIG. 19F is a first side view of a particular embodiment of a material handling system, whereby a transfer opening disposes in an open condition, a container second end opening disposes in a closed condition, and a pass-through is formed by the transfer opening and a container first end opening of a container, whereby compacted material is transferred from a receptacle into the container by passing the compacted material through the pass-through.

Figure 19G:
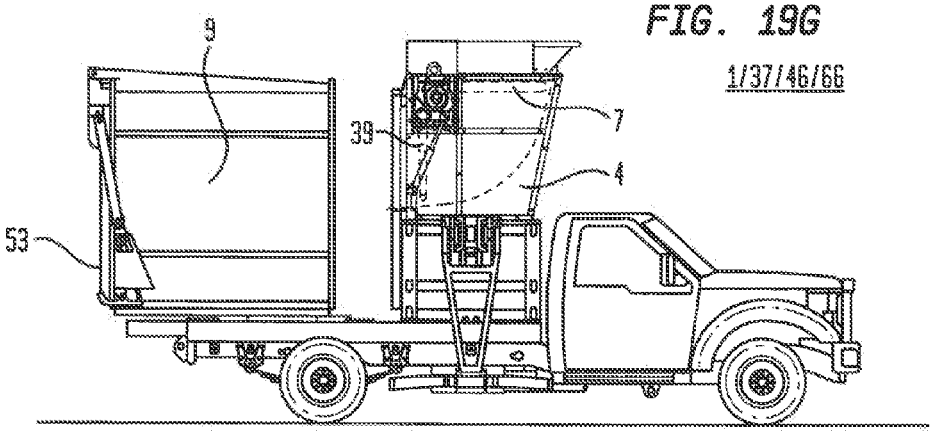

FIG. 19G is a first side view of a particular embodiment of a material handling system, whereby each of a loading opening, a transfer opening, and a container second end opening dispose in a closed condition, and a container slides rearwardly away from a cab of a vehicle to which the material handling system couples.

Figure 19H:
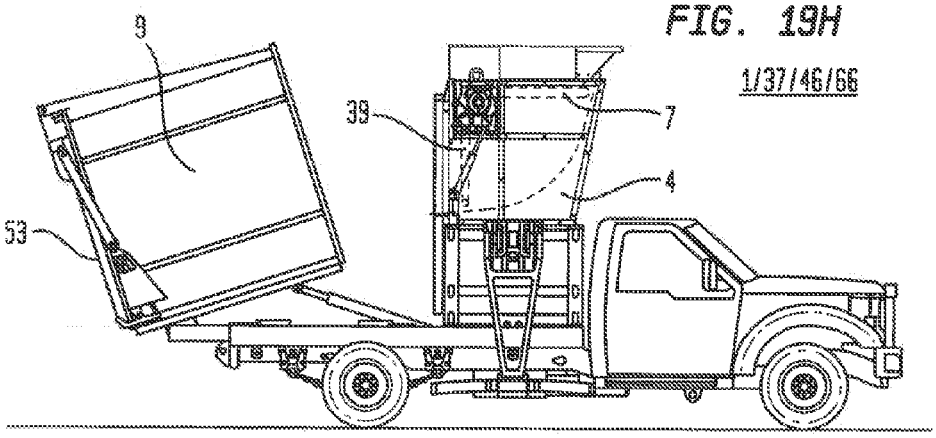

FIG. 19H is a first side view of a particular embodiment of a material handling system, whereby each of a loading opening, a transfer opening, and a container second end opening dispose in a closed condition, and a container rotates to facilitate egression of compacted material from the container through a container second end opening.

Figure 19I:
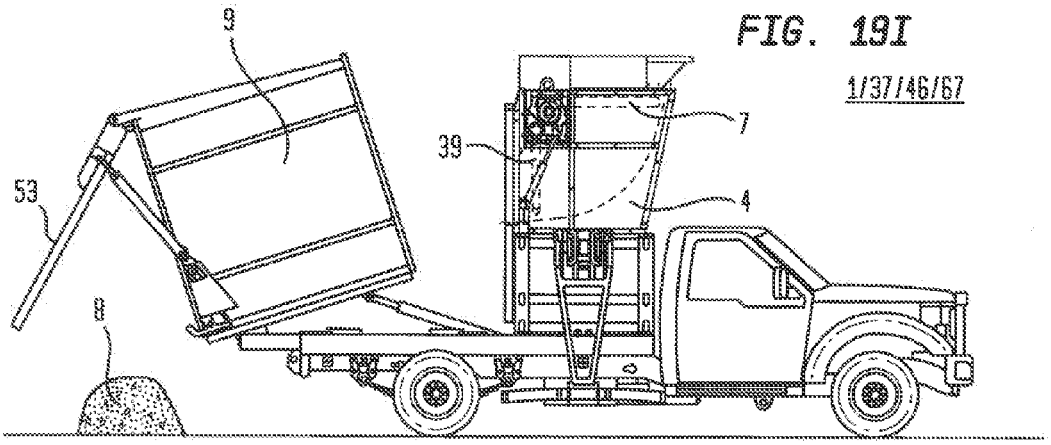

FIG. 19I is a first side view of a particular embodiment of a material handling system, whereby a container second end opening disposes in an open condition, each of a loading opening and a transfer opening dispose in a closed condition, and a container second end wall rotates to facilitate egression of compacted material from the container through a container second end opening.

III. DETAILED DESCRIPTION OF THE PREFERRED EMBODIMENTS

Now referring primarily to FIG. 1, FIG. 2, and FIG. 19A through FIG. 19H, which illustrate methods of using a particular embodiment of a material handling system (1) to handle material (2), for example refuse (3), whereby the material handling system (1) includes a receptacle (4), a loading opening (5) disposed within the receptacle (4), a transfer opening (6) disposed within the receptacle (4) in adjacent angled relation to the loading opening (5), and a first compaction plate (7) rotatably coupled proximate the receptacle (4) between the loading opening (5) and the transfer opening (6). The method of using the material handling system (1) can include loading material (2) into the receptacle (4) by passing the material (2) through the loading opening (5) and compacting the material (2) loaded into the receptacle (4) by rotating the first compaction plate (7) to generate compacted material (8).

Now referring primarily to FIG. 19F, as to particular embodiments, the method of using the material handling system (1) can, but need not necessarily, further include transferring the compacted material (8) from the receptacle (4) into a container (9) disposed proximate the transfer opening (6) by passing the compacted material (8) through the transfer opening (6).

Now referring primarily to FIG. 19G through FIG. 19I, as to particular embodiments, the method of using the material handling system (1) can, but need not necessarily, further include sliding and rotating the container (9) to facilitate egression of the compacted material (8) from the container (9) through a container second end (10).

Now referring primarily to FIG. 1 through FIG. 14, the material handling system (1) includes a substantially hollow receptacle (4) having a receptacle length (11) disposed between receptacle first and second ends (12)(13), a receptacle width (14) disposed between receptacle first and second sides (15)(16), and a receptacle height (17) disposed between receptacle top and bottom portions (18)(19).

Now referring primarily to FIG. 8 through FIG. 14, the receptacle first and second sides (15)(16) can be defined by respective receptacle first and second side walls (20)(21), which dispose in opposed relation. Further, the receptacle first end (12) can be defined by a receptacle first end wall (22) coupled or joined between the opposing receptacle first and second side walls (20)(21). As to particular embodiments, the receptacle first end wall (22) can have a generally concave receptacle first end wall internal surface (23).

Again referring primarily to FIG. 8 through FIG. 14, the material handling system (1) can, but need not necessarily, further include one or more upper panels (24) coupled proximate a perimeter defined by the receptacle first end wall (22) and the opposing receptacle first and second side walls (20)(21). As to particular embodiments, the one or more upper panels (24) can be coupled in angled relation, for example in outwardly-extending angled relation, to the receptacle first end wall (22) and the opposed receptacle first and second side walls (20)(21).

Figure 8A:
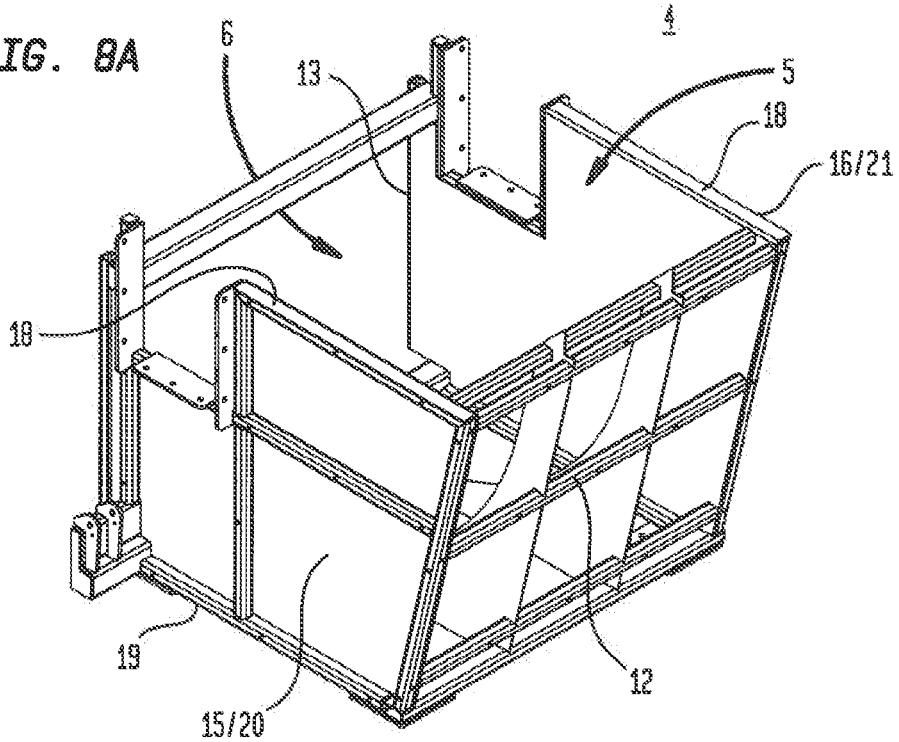
FIG. 8A is a perspective view of a particular embodiment of a receptacle of the material handling system.
Figure 8B:
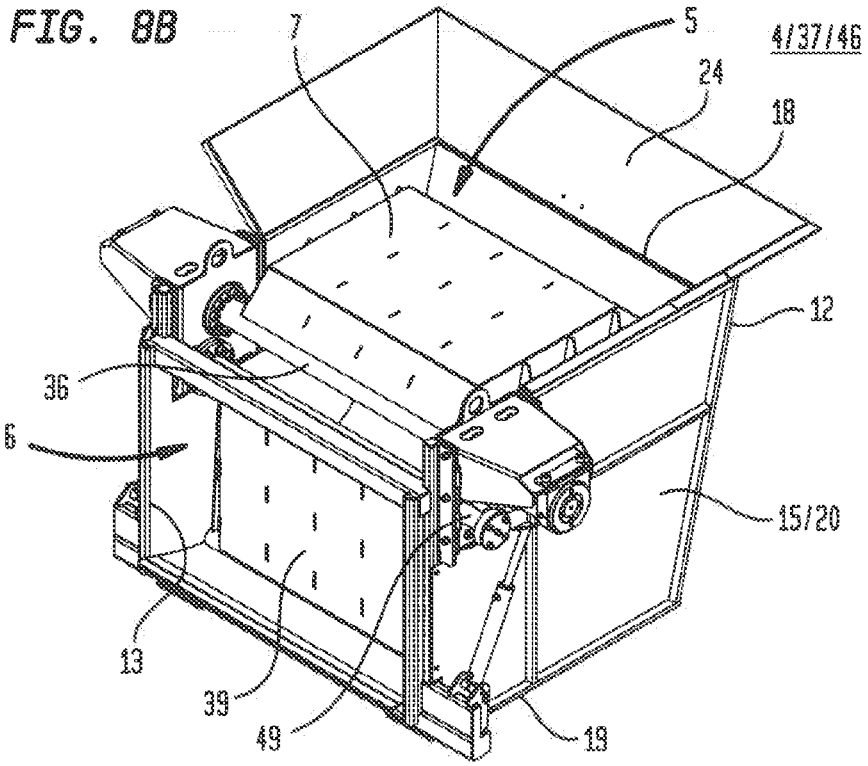
FIG. 8B is a perspective view of a particular embodiment of a receptacle of the material handling system, whereby a first compaction plate rotatably couples proximate the receptacle between a loading opening and a transfer opening and a second compaction plate movably disposes proximate the transfer opening.
Figure 9:
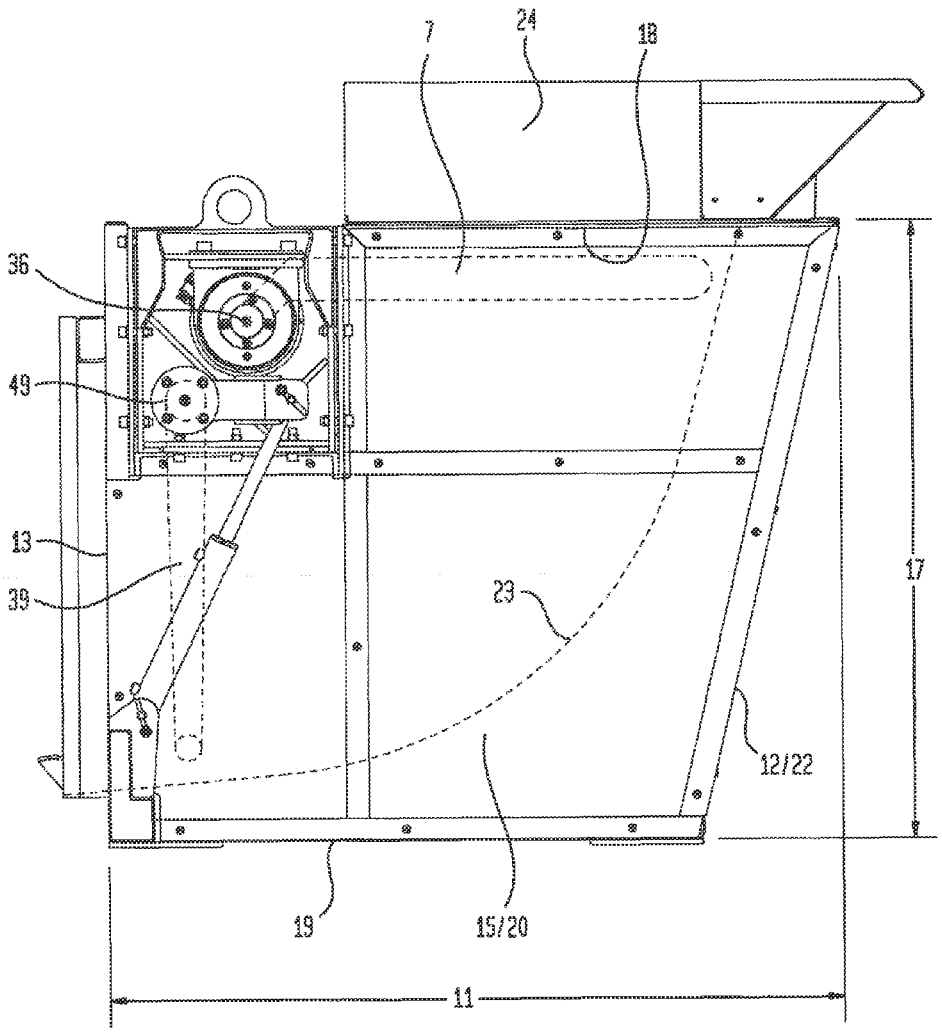
FIG. 9 is a first side view of a particular embodiment of a receptacle of the material handling system, whereby a first compaction plate rotatably couples proximate the receptacle between a loading opening and a transfer opening and a second compaction plate movably disposes proximate the transfer opening.
Figure 10:
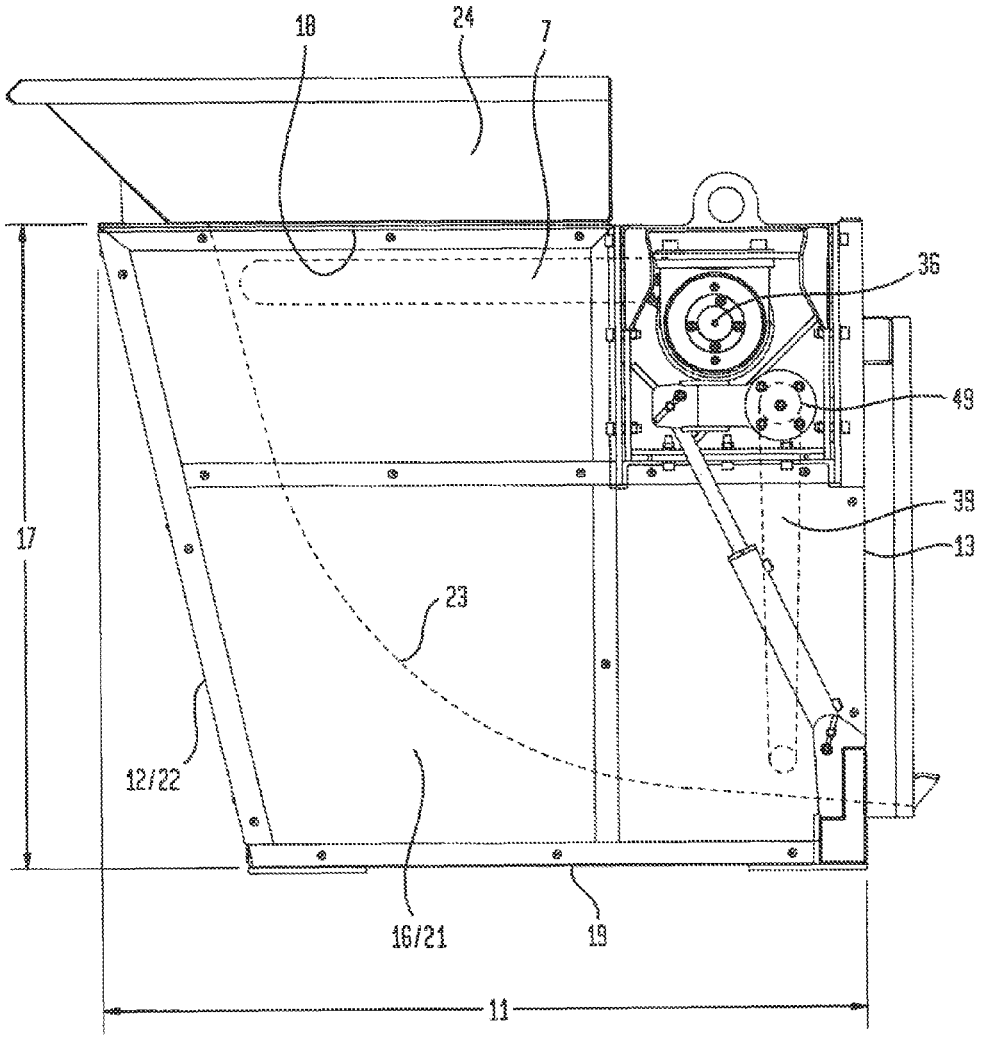
FIG. 10 is a second side view of a particular embodiment of a receptacle of the material handling system, whereby a first compaction plate rotatably couples proximate the receptacle between a loading opening and a transfer opening and a second compaction plate movably disposes proximate the transfer opening.
Figure 11:
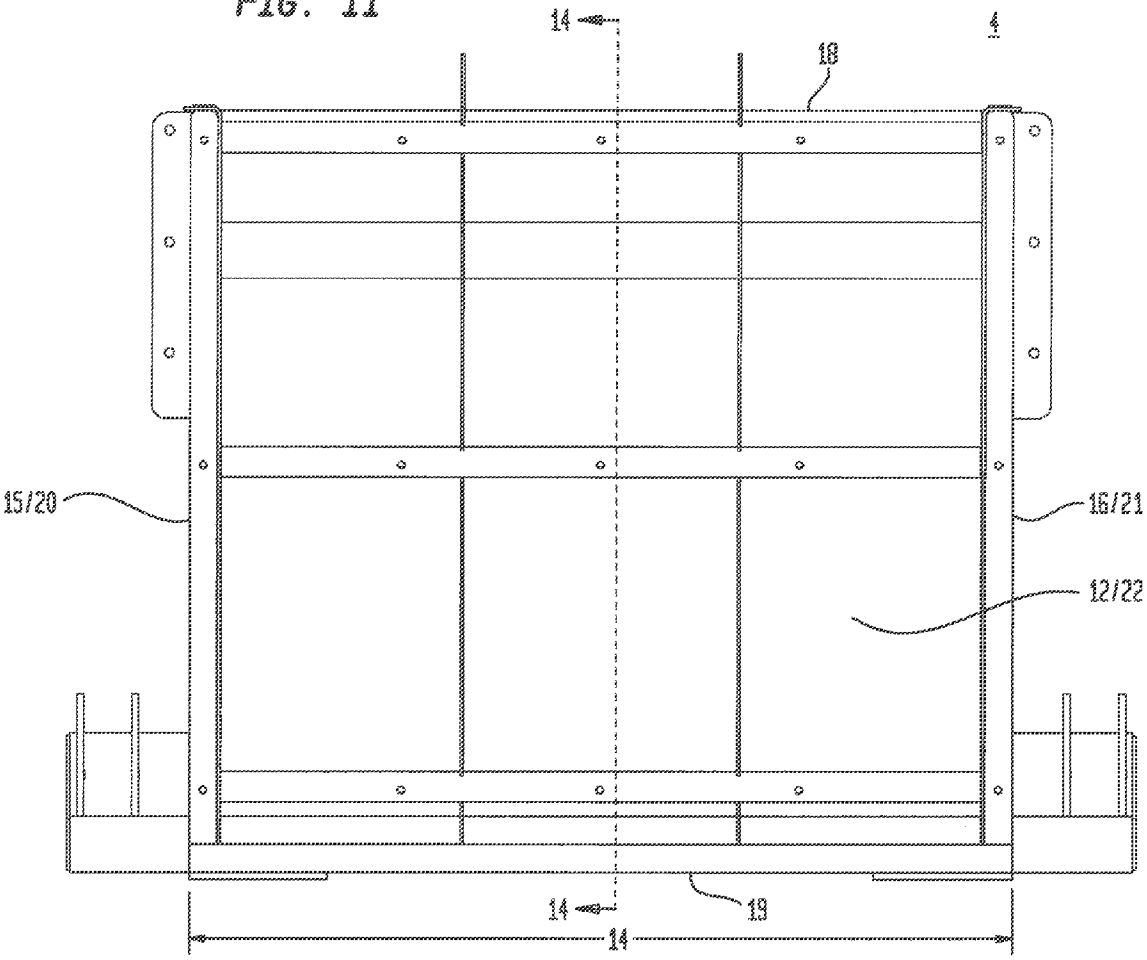
FIG. 11 is a first end view of a particular embodiment of a receptacle of the material handling system.
Figure 12:
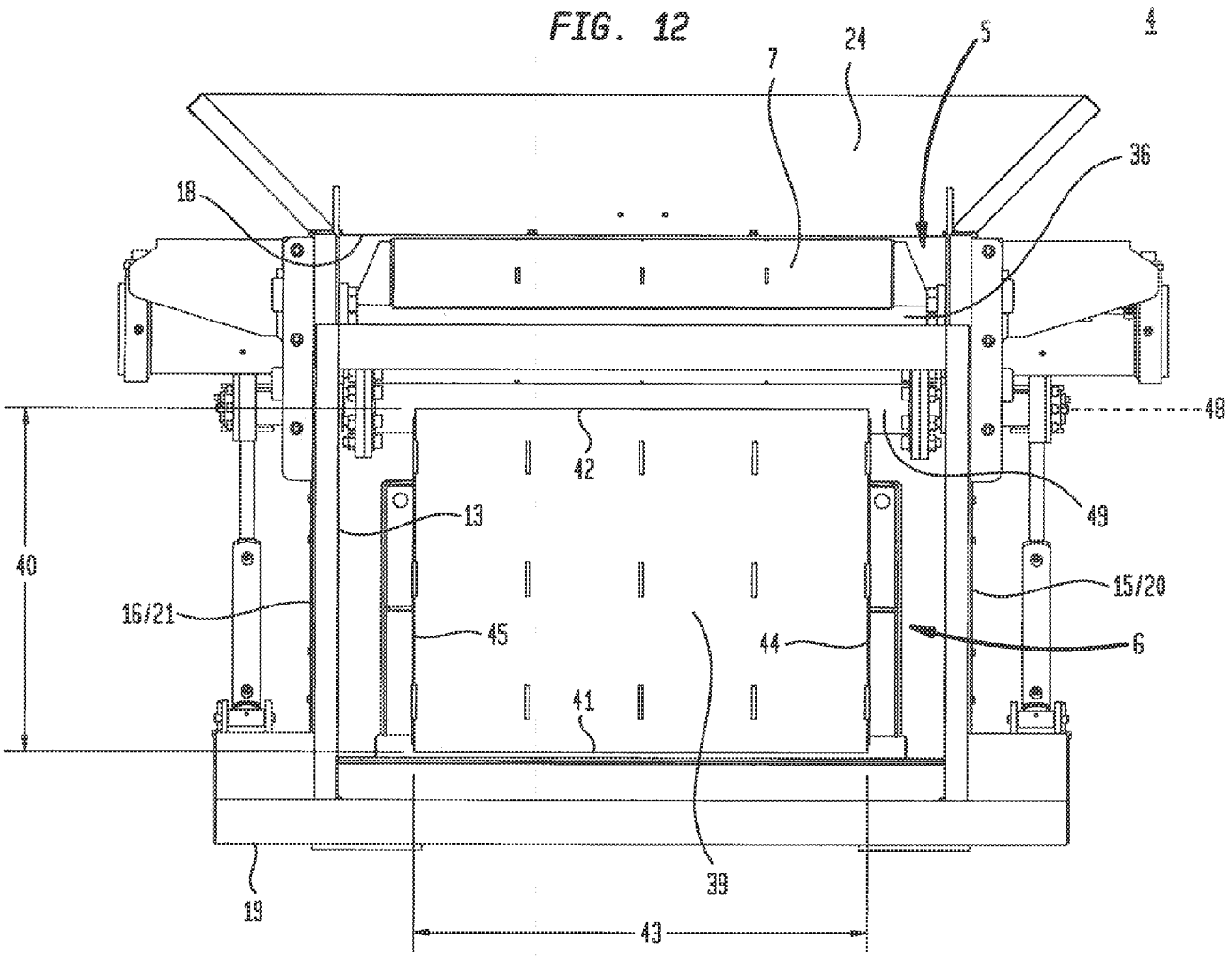
FIG. 12 is a second end view of a particular embodiment of a receptacle of the material handling system, whereby a first compaction plate rotatably couples proximate the receptacle between a loading opening and a transfer opening and a second compaction plate movably disposes proximate the transfer opening.
Figure 13:
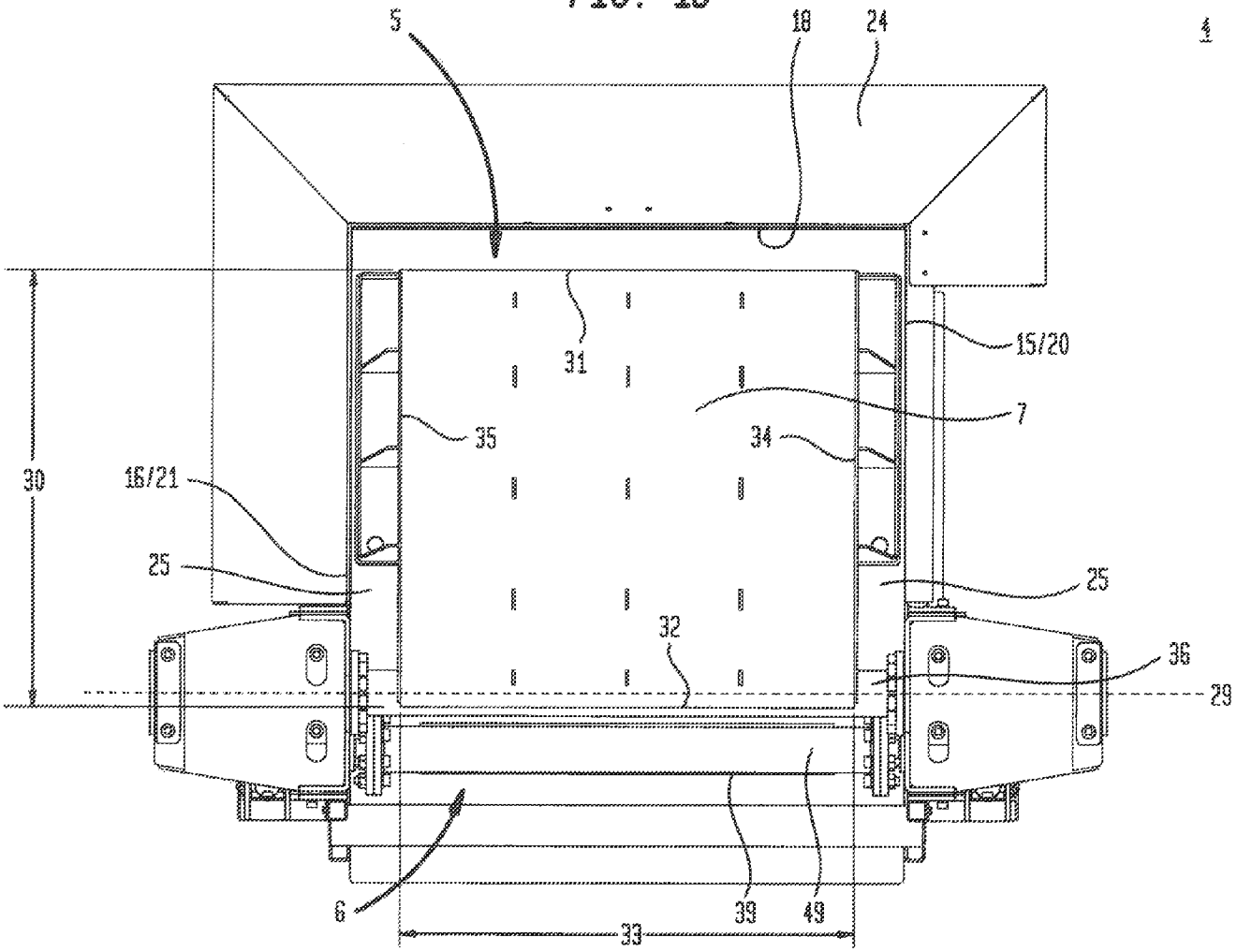
FIG. 13 is a top view of a particular embodiment of a receptacle of the material handling system, whereby a first compaction plate rotatably couples proximate the receptacle between a loading opening and a transfer opening and a second compaction plate movably disposes proximate the transfer opening.
Figure 14:
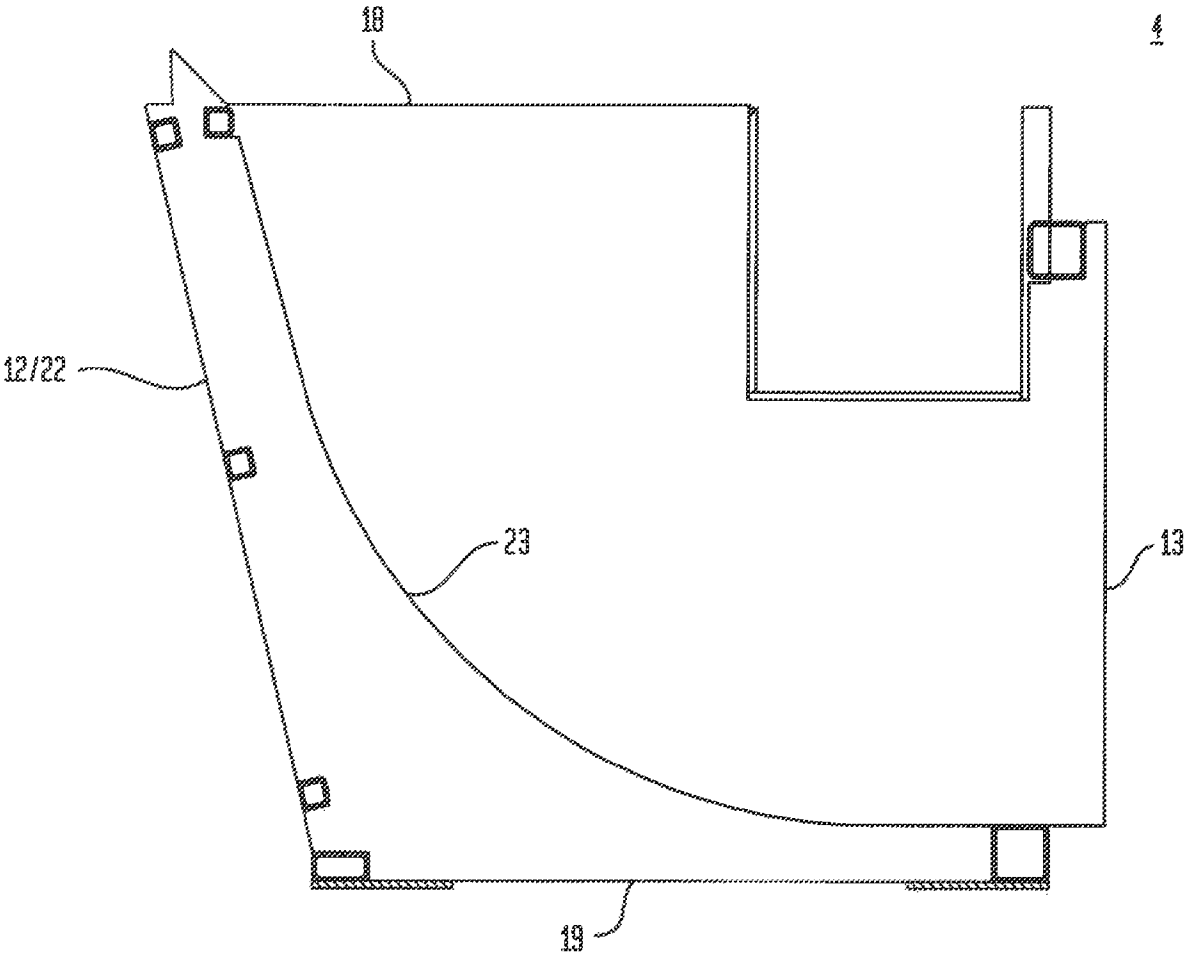
FIG. 14 is a cross-sectional view 14-14 of the particular embodiment of the receptacle shown in FIG. 11.
Figure 15A:
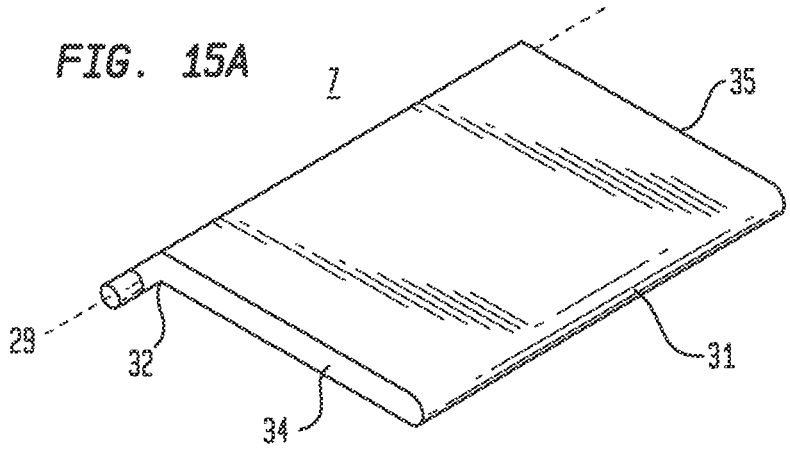
FIG. 15A is a perspective view of a particular embodiment of a first compaction plate of the material handling system.
Figure 15B:
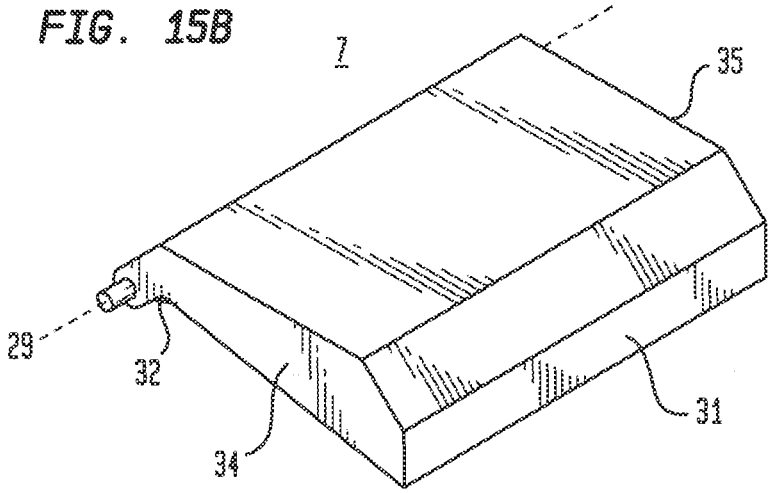
FIG. 15B is a perspective view of a particular embodiment of a first compaction plate of the material handling system.
Figure 15C:
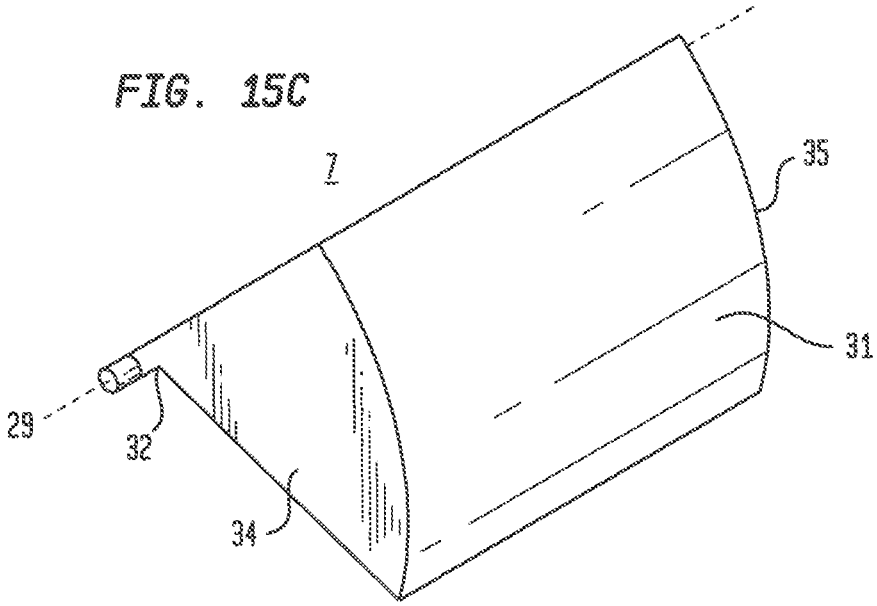
FIG. 15C is a perspective view of a particular embodiment of a first compaction plate of the material handling system.
Figure 16:
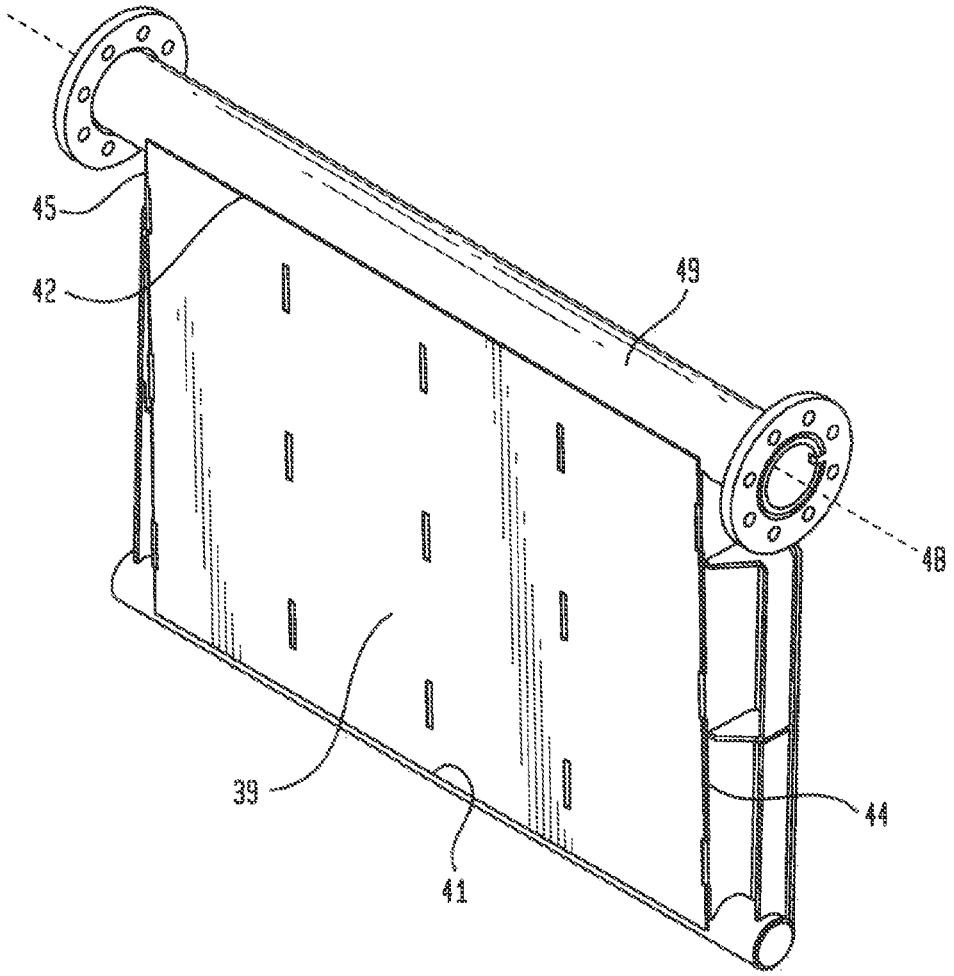
FIG. 16 is a perspective view of a particular embodiment of a second compaction plate of the material handling system.

Now referring primarily to FIG. 8, FIG. 12, and FIG. 13, the receptacle (4) can include a loading opening (5) and a transfer opening (6) disposed within the receptacle (4) in adjacent angled relation. As to particular embodiments, the loading opening (5) can be disposed proximate a receptacle top portion (18) and the transfer opening (6) can be disposed proximate the receptacle second end (13), whereby both the loading opening (5) and the transfer opening (6) communicate with a receptacle interior space (25).

Figure 1:
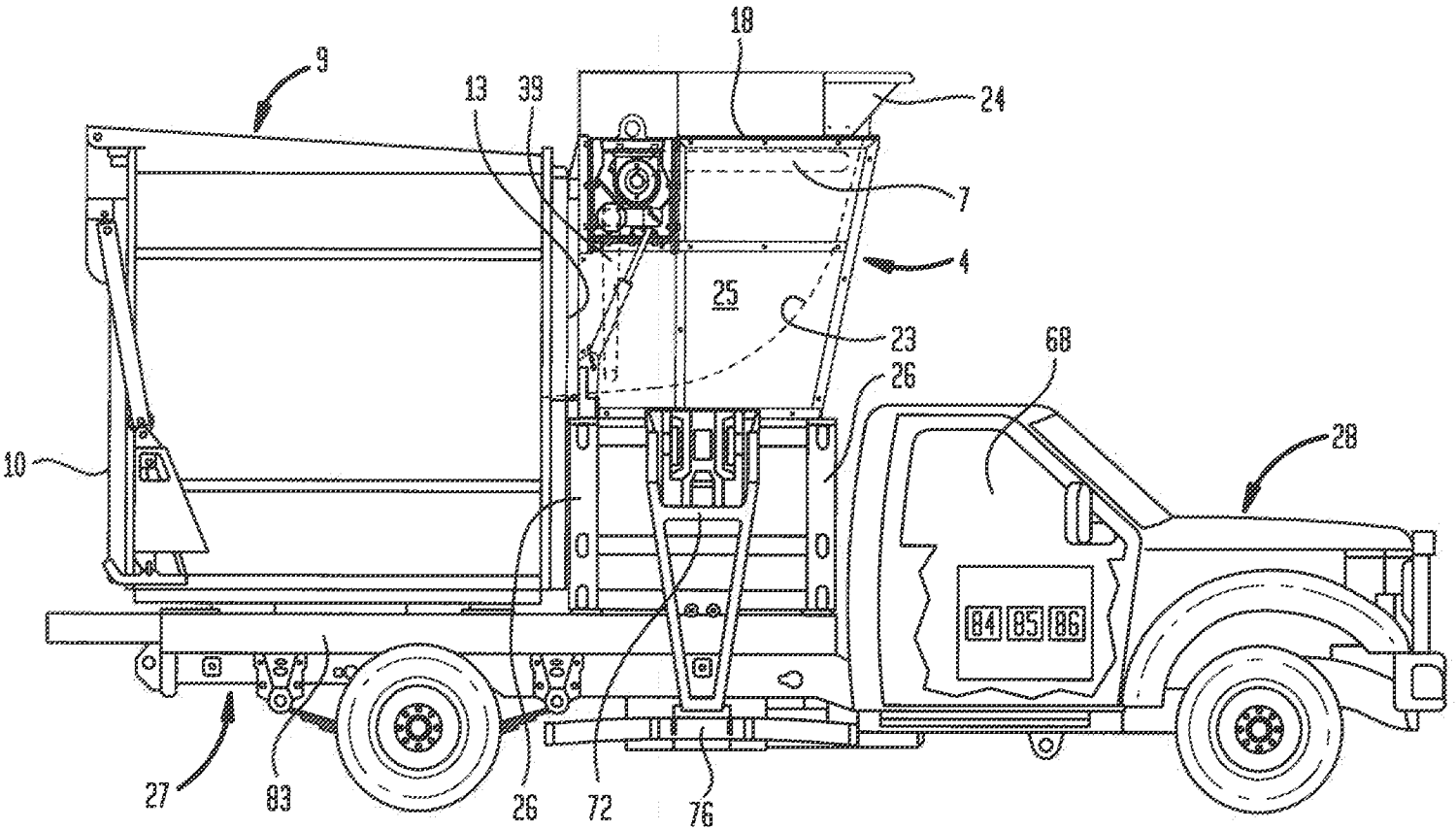
FIG. 1 is a first side view of a particular embodiment of a material handling system, whereby a rotatable arm disposes downwardly.
Figure 2:
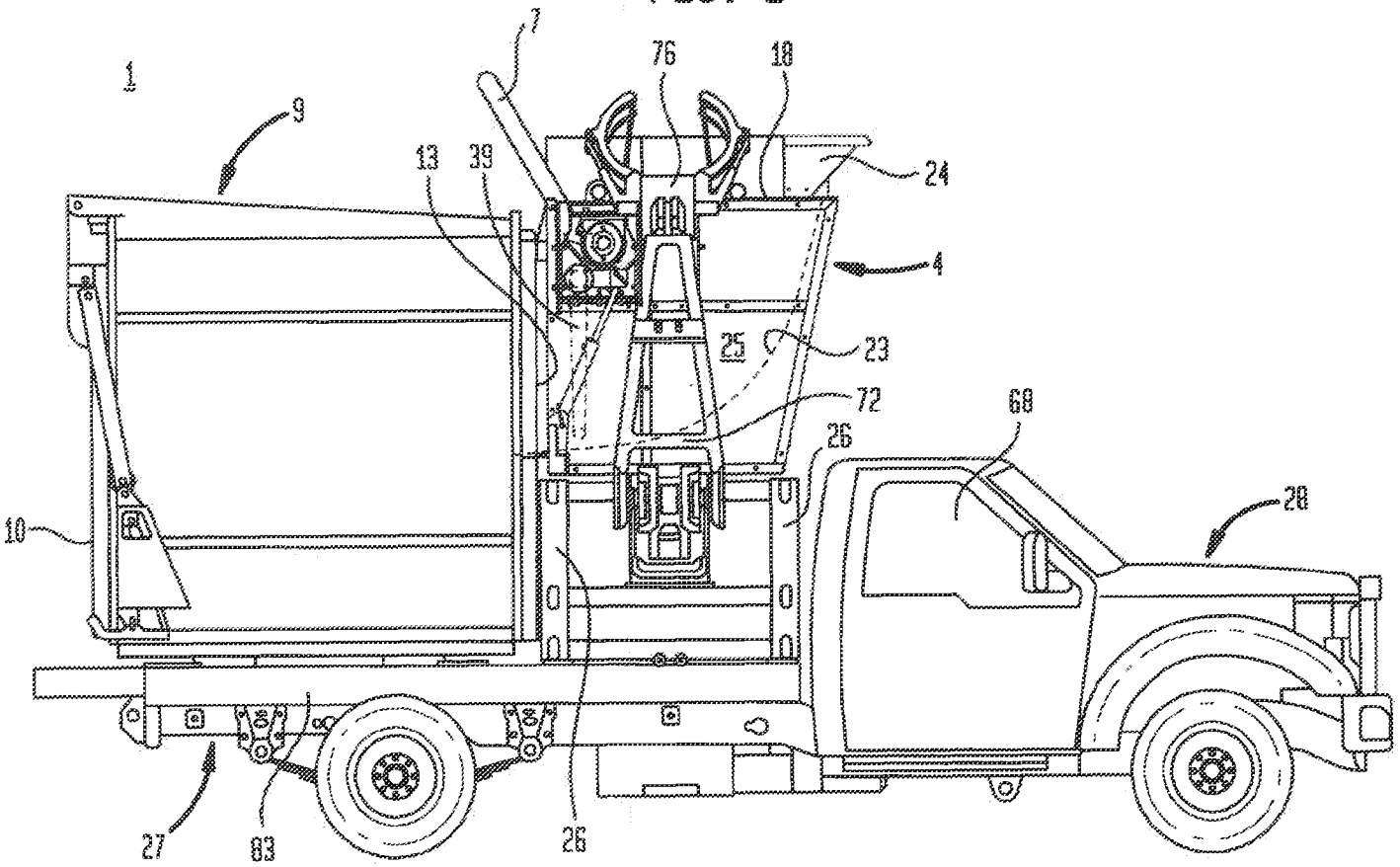
FIG. 2 is a first side view of a particular embodiment of a material handling system, whereby a rotatable arm disposes upwardly proximate a loading opening disposed within a receptacle.
Figure 3:
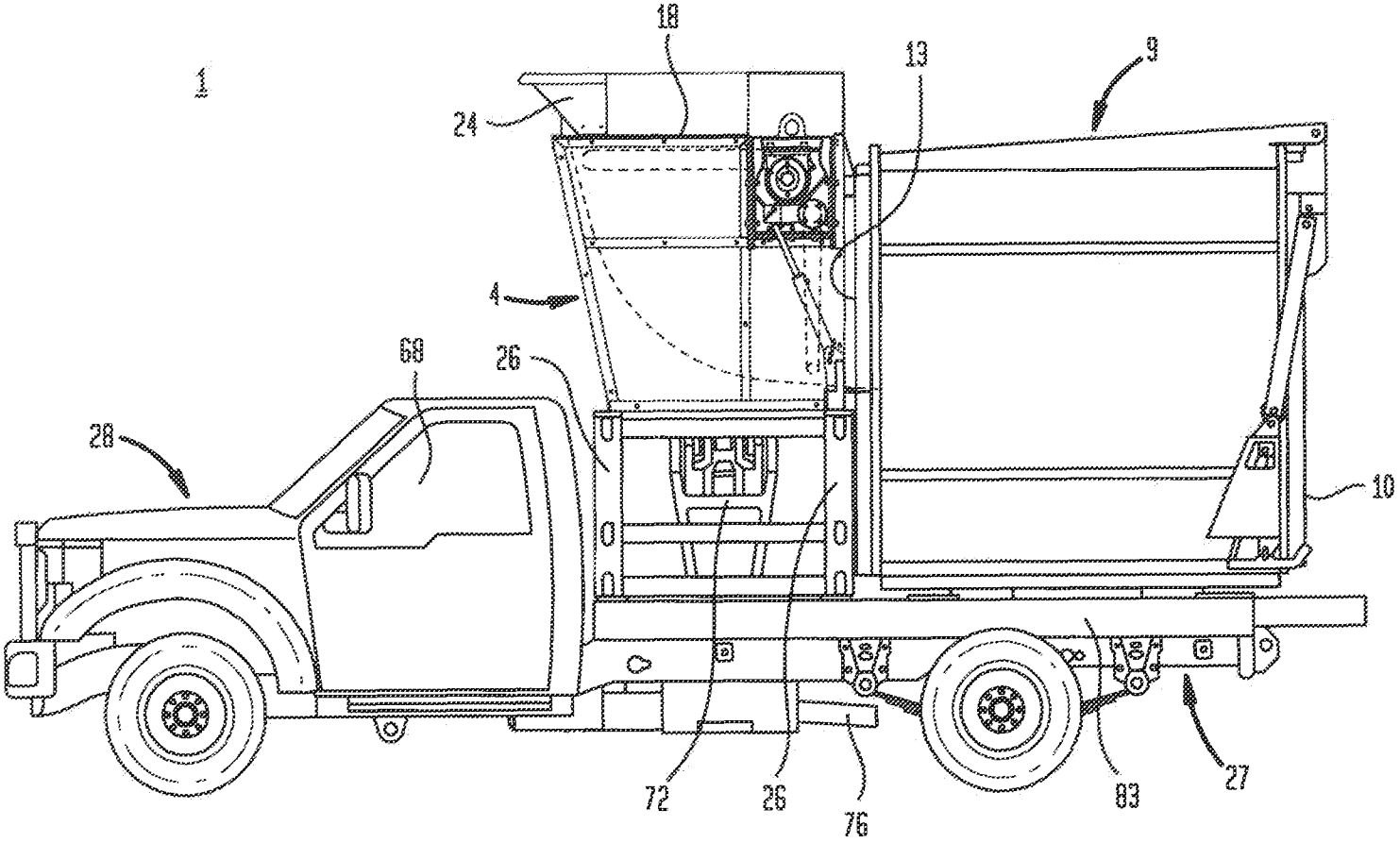
FIG. 3 is a second side view of a particular embodiment of a material handling system, whereby a rotatable arm disposes downwardly.
Figure 4:
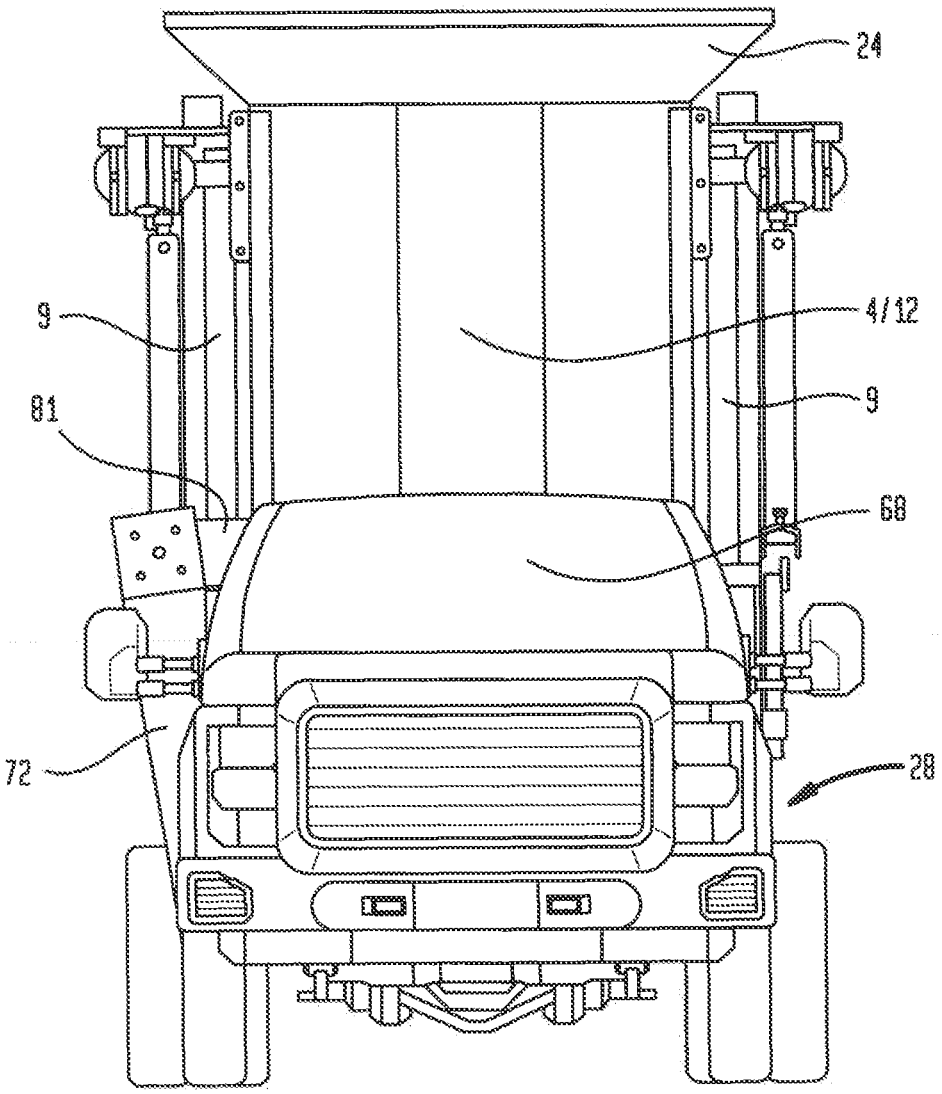
FIG. 4 is a front view of a particular embodiment of a material handling system, whereby a rotatable arm disposes downwardly.
Figure 5:
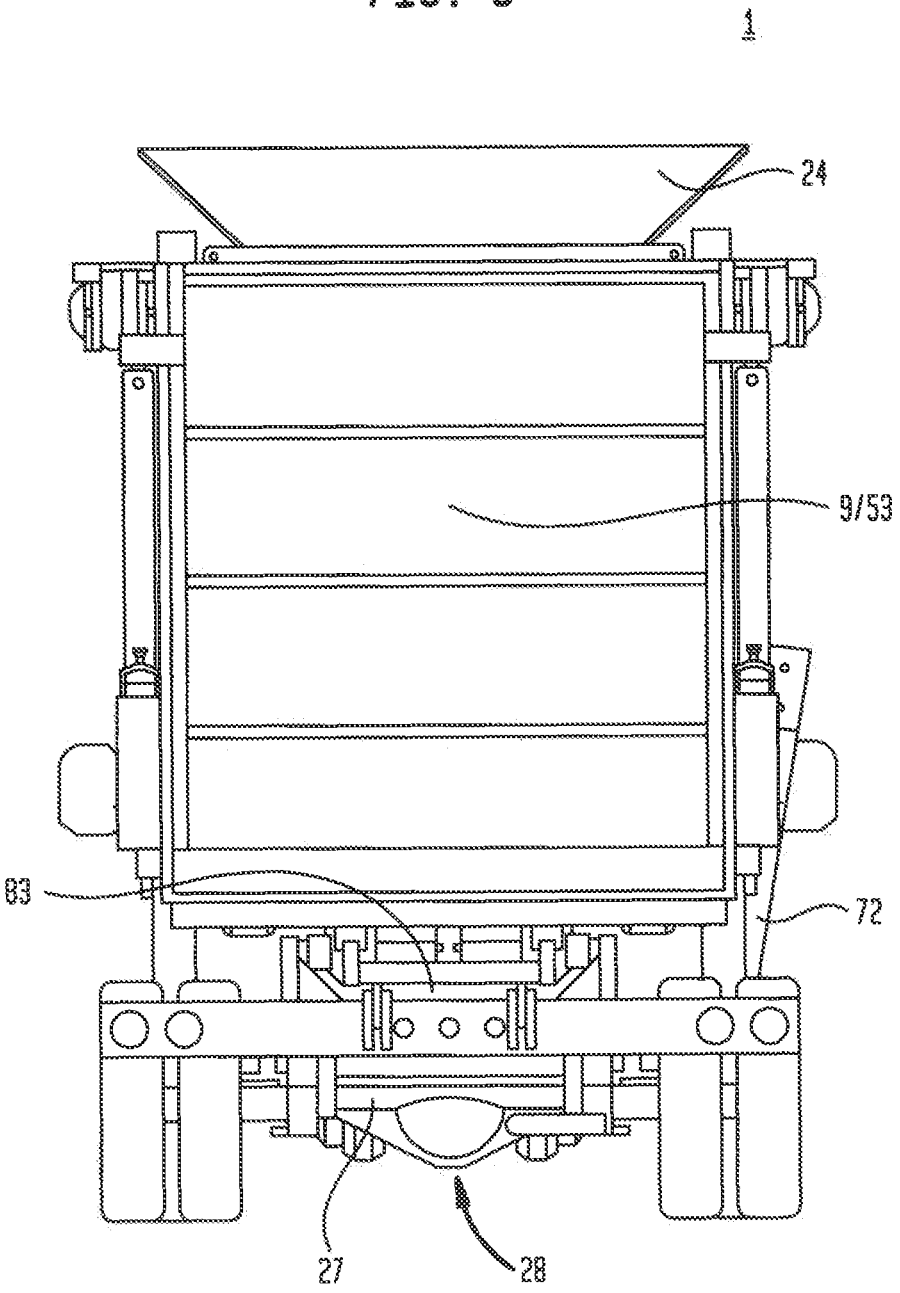
FIG. 5 is a rear view of a particular embodiment of a material handling system, whereby a rotatable arm disposes downwardly.
Figure 6:
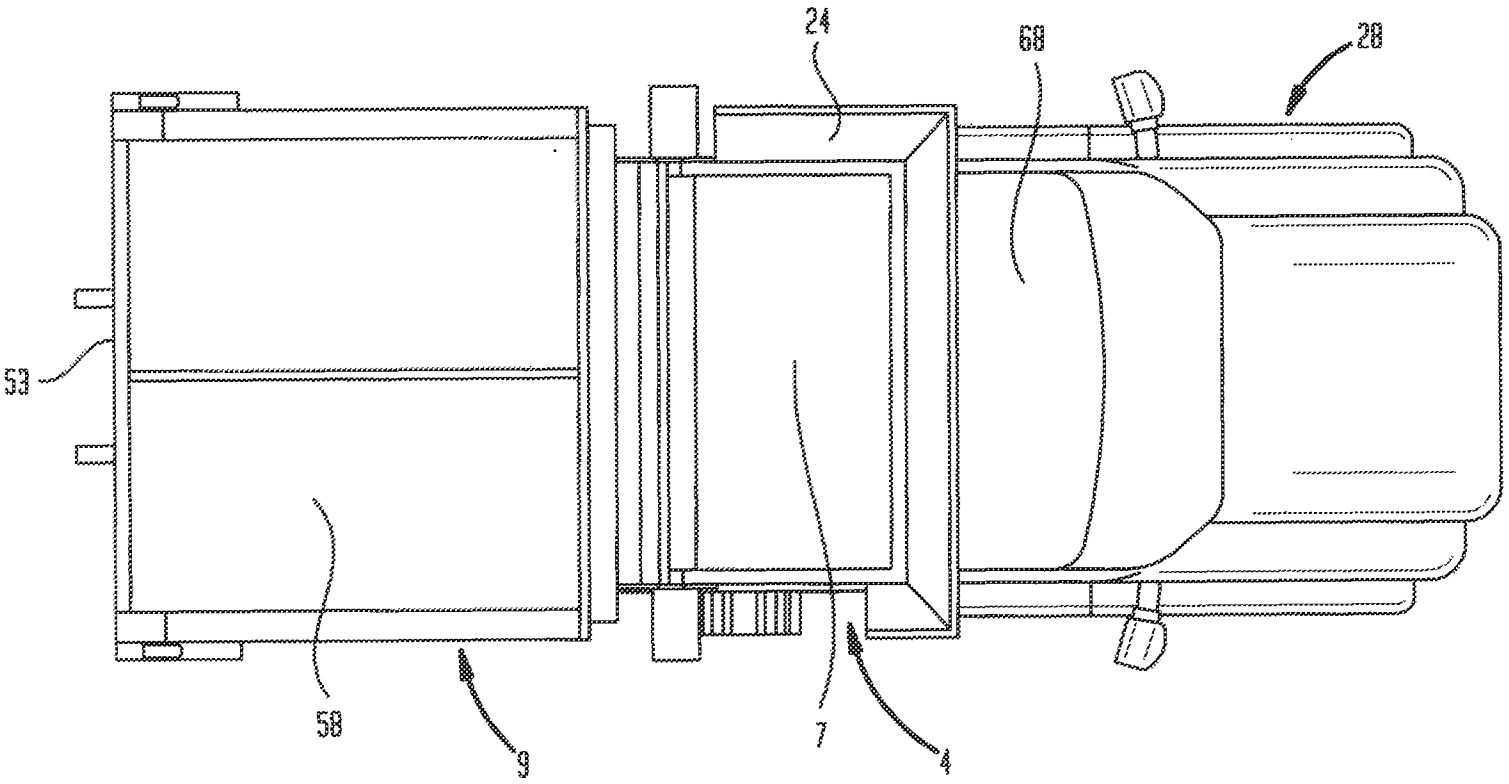
FIG. 6 is a top view of a particular embodiment of a material handling system, whereby a rotatable arm disposes downwardly.
Figure 7:
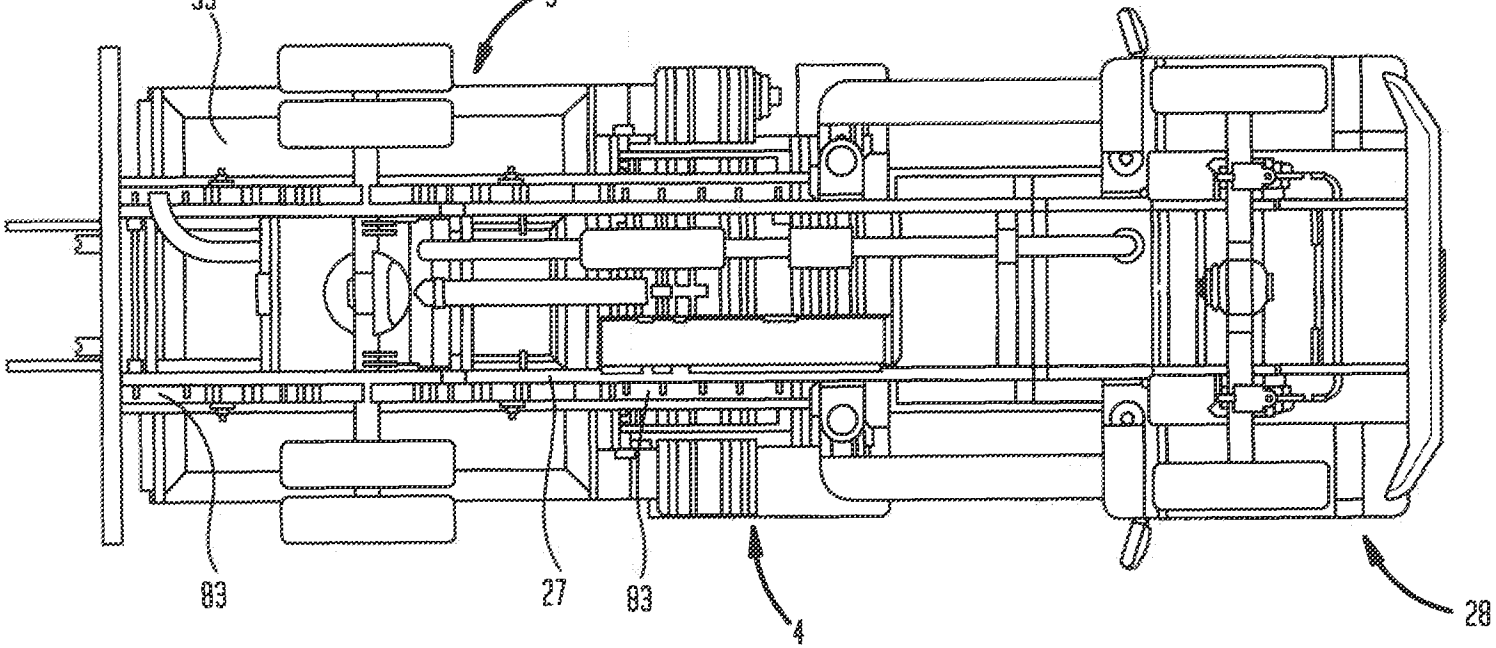
FIG. 7 is a bottom view of a particular embodiment of a material handling system, whereby a rotatable arm disposes downwardly.

Now referring primarily to FIG. 1 through FIG. 3, the material handling system (1) can but need not necessarily, further include one or more receptacle supports (26) coupled to the receptacle (4), whereby the one or more receptacle supports (26) can support the receptacle (4) above a chassis

(27) of a vehicle (28) to which the material handling system (1) couples. As to particular embodiments, the one or more receptacle supports (26) can be configured for relatively easy and relatively quick coupling to the chassis (27) of the vehicle (28), whereby the coupling can be accomplished without altering the chassis (27) or the vehicle (28) by means such as welding or drilling.

Now referring primarily to FIG. 8, FIG. 12, FIG. 13, FIG. 15A, FIG. 15B, and FIG. 15C, the material handling system (1) further includes a first compaction plate (7) rotatably coupled proximate the receptacle (4) to allow the first compaction plate (7) to reciprocally rotate about a first compaction plate rotation axis (29) (as shown in the example of FIG. 13).

Now referring primarily to FIG. 13, the first compaction plate (7) can have a first compaction plate length (30) disposed between first compaction plate first and second ends (31)(32) and a first compaction plate width (33) disposed between first compaction plate first and second sides (34)(35). As to particular embodiments, the first compaction plate length (30) and the first compaction plate width (33) can be configured to span substantially the entirety or the entirety of the loading opening (5).

Now referring primarily to FIG. 8, FIG. 12, FIG. 13, the first compaction plate second end (32) can be rotatably coupled between opposing receptacle first and second side walls (20)(21) to dispose the first compaction plate rotation axis (29) between the loading opening (5) and the transfer opening (6), allowing the first compaction plate first end (31) to move toward or away from the loading opening (5), the transfer opening (6), or combinations thereof.

The first compaction plate (7) can be rotated by a first compaction plate rotation actuator (36) to overlay the loading opening (5), thereby achieving a loading opening closed condition (37) in which passage through the loading opening (5) is precluded by the first compaction plate (7) (as shown in the examples of FIG. 19A, FIG. 19G, FIG. 19H, and FIG. 19I). From the loading opening closed condition (37), a loading opening open condition (38) can be achieved upon rotation of the first compaction plate (7), which can be driven by the first compaction plate rotation actuator (36), to move the first compaction plate first end (31) upward, rearward, or combinations thereof, accordingly disposing the first compaction plate (7) in angled relation to the loading opening (5) (as shown in the examples of FIG. 19B and FIG. 19C), whereby material (2) can pass through the loading opening (5).

Now referring primarily to FIG. 8, FIG. 12, FIG. 13, and FIG. 16, the material handling system (1) can, but need not necessarily, further include a second compaction plate (39) movably disposed proximate the transfer opening (6).

Now referring primarily to FIG. 12, the second compaction plate (39) can have a second compaction plate length (40) disposed between second compaction plate first and second ends (41)(42) and a second compaction plate width (43) disposed between second compaction plate first and second sides (44)(45). As to particular embodiments, the second compaction plate length (40) and the second compaction plate width (43) can be configured to span substantially the entirety or the entirety of the transfer opening (6).

As to particular embodiments, the second compaction plate (39) can be slidably disposed proximate the transfer opening (6), whereby the second compaction plate (39) can be slidably moved to overlay the transfer opening (6), thereby achieving a transfer opening closed condition (46) in which passage through the transfer opening (6) is precluded by the second compaction plate (39). From the transfer opening closed condition (46), a transfer opening open condition (47) can be achieved upon slidable movement of the second compaction plate (39) away from the transfer opening (6), such as below the transfer opening (6), whereby material (2) can pass through the transfer opening (6).

As to other particular embodiments, the second compaction plate (39) can be rotatably coupled proximate the transfer opening (6) to allow the second compaction plate (39) to reciprocally rotate about a second compaction plate rotation axis (48) (as shown in the example of FIG. 12). For example, the second compaction plate second end (42) can be rotatably coupled between opposing receptacle first and second side walls (20)(21) to dispose the second compaction plate rotation axis (48) between the loading opening (5) and the transfer opening (6), allowing the second compaction plate first end (41) to move toward or away from the transfer opening (6).

The second compaction plate (39) can be rotated by a second compaction plate rotation actuator (49) to overlay the transfer opening (6), thereby achieving the transfer opening closed condition (46) in which passage through the transfer opening (6) is precluded by the second compaction plate (39) (as shown in the examples of FIG. 19A, FIG. 19B, FIG. 19C, FIG. 19D, FIG. 19E, FIG. 19G, FIG. 19H, and FIG. 19I). From the transfer opening closed condition (46), the transfer opening open condition (47) can be achieved upon rotation of the second compaction plate (39), which can be driven by the second compaction plate rotation actuator (49), to move the second compaction plate first end (41) rearward, upward, or combinations thereof, accordingly disposing the second compaction plate (39) in angled relation to the transfer opening (6) (as shown in the example of FIG. 19F), whereby material (2) can pass through the transfer opening (6).

As to particular embodiments, the second compaction plate (39) can be rotated to move the second compaction plate first end (41) rearward, upward, or combinations thereof, upon forcible urging by the first compaction plate (7).

Now referring primarily to FIG. 19D and FIG. 19E, when the second compaction plate (39) overlays the transfer opening (6) to achieve the transfer opening closed condition (46), the second compaction plate (39) can be in an immovable condition (50) in which the second compaction plate (39) maintains its position, even upon forcible urging.

Accordingly, upon rotation of the first compaction plate (7) about the first compaction plate rotation axis (29) toward the second compaction plate (39) in the immovable condition (50), material (2), for example refuse (3), disposed between the first and second compaction plates (7)(39) can be compacted by forcible urging of the first compaction plate (7) upon the material (2) and against the second compaction plate (39) in the immovable condition (50) to generate compacted material (8).

Now referring primarily to FIG. 1 through FIG. 7, FIG. 17A, and FIG. 17B, the material handling system (1) can, but need not necessarily, further include a substantially hollow container (9) disposed proximate the transfer opening (6). The container (9) can have a container length (51) disposed between container first and second end walls (52)(53), a container width (54) disposed between container first and second side walls (55)(56), and a container height (57) disposed between container top and bottom walls (58)(59), whereby the walls (52)(53)(55)(56)(58)(59) can define a container interior space (60).

As to particular embodiments, the container length (51) can be an adjustable container length (51), which can be adjusted between lesser and greater container lengths (51), whereby a greater container length (51) provides a greater amount of container interior space (60) relative to a lesser container length (51), which provides a lesser amount of container interior space (60).

Figure 17A:
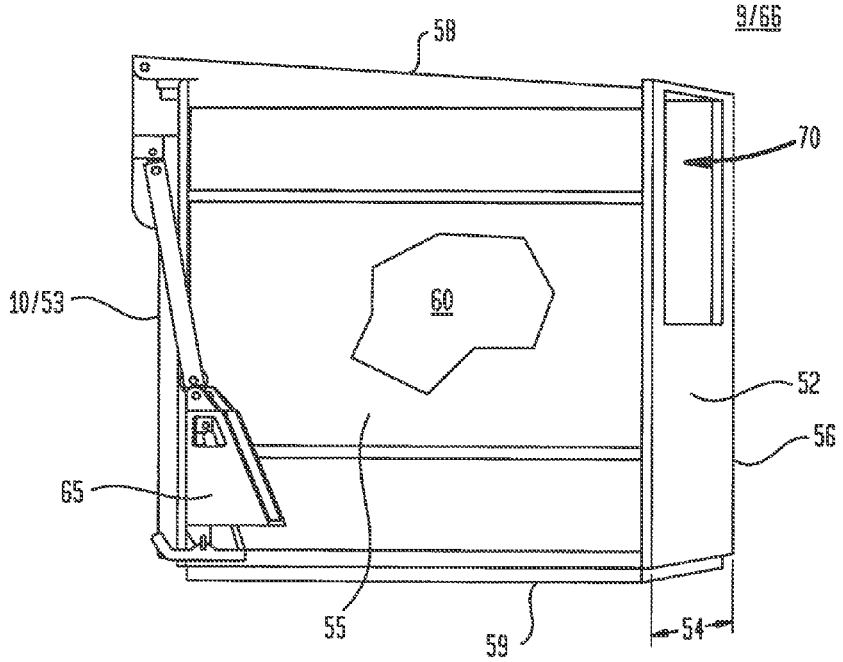
FIG. 17A is a perspective view of a particular embodiment of a container of the material handling system, whereby a container first end opening disposed within a container first end wall can be seen.
Figure 17B:
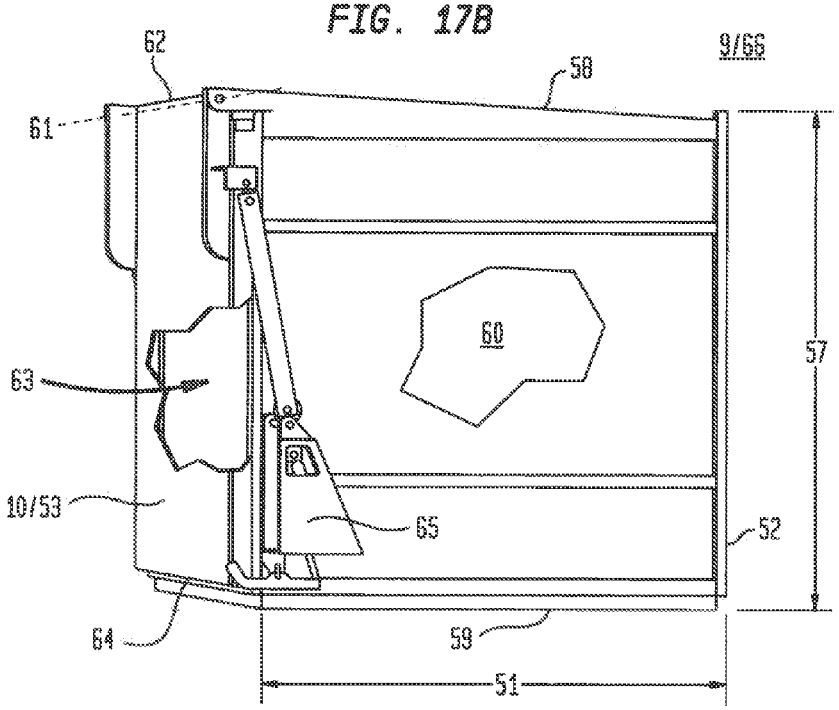
FIG. 17B is a perspective view of a particular embodiment of a container of the material handling system, whereby a container second end opening disposed can be seen.

Now referring primarily to FIG. 17A, FIG. 17B, and FIG. 19I, as to particular embodiments, the container second end wall (53) can be movably coupled to the container (9). As an illustrative example, the container second end wail (53) can be rotatably coupled to the container (9) to allow the container second end wall (53) to reciprocally rotate about a container second end wall rotation axis (61) (as shown in the example of FIG. 17B). For example, a container second end wall upper end (62) can be rotatably coupled between opposing container first and second side walls (55)(56) to dispose the container second end wall rotation axis (61) above a container second end opening (63), allowing a container second end wall lower end (64) to move toward or away from the container second end opening (63).

The container second end wall (53) can be rotated, such as by gravitational forces or by a container second end wall rotation actuator (65), to overlay the container second end opening (63), thereby achieving a container second end opening closed condition (66) in which passage through the container second end opening (63) is precluded by the container second end wall (53) (as shown in the examples of FIG. 19A, FIG. 19B, FIG. 19C, FIG. 19D, FIG. 19E, FIG. 19F, FIG. 19G, and FIG. 19H). From the container second end opening closed condition (66), a container second end opening open condition (67) can be achieved upon rotation of the container second end wall (53), which can be driven by gravitational forces or by the container second end wall rotation actuator (65), to move the container second end wall lower end (64) away from the container second end opening (63), accordingly disposing the container second end wall (53) in angled relation to the container second end opening (63) (as shown in the example of FIG. 19H), whereby compacted material (8) can pass through the container second end opening (63).

As to particular embodiments, the container (9) can be slidably disposed on the chassis (27) of the vehicle (28) to which the material handling system (1) couples. Accordingly, the container (9) can slide toward or away from a cab (68) of the vehicle (28), whereby rearwardly sliding the container (9) away from the cab (68) may be useful when unloading compacted material (8) within the container (9) by passing the compacted material (8) through the container second end opening (63) (as shown in the examples of FIG. 190, FIG. 19H, and FIG. 19I).

As to particular embodiments, the container (9) can be rotatably coupled to the chassis (27) of the vehicle (28) to which the material handling system (1) couples. Accordingly, the container (9) can reciprocally rotate about a container rotation axis (as shown in the examples of FIG. 19H and FIG. 19I), which may be useful when unloading compacted material (8) within the container (9) by passing the compacted material (8) through the container second end opening (63).

Now referring primarily to FIG. 17A, the container (9) can include a container first end opening (70) disposed within the container first end wall (52), whereby the container first end opening (70) disposes adjacent the transfer opening (6) to form a pass-through (71) between the receptacle interior space (25) and the container interior space (60). Accordingly, when the second compaction plate (39) overlays the transfer opening (6) to achieve the transfer opening closed condition (46), passage through the pass-Through (71) is precluded by the second compaction plate (39), correspondingly precluding communication between the receptacle interior space (25) and the container interior space (60). Following, when the second compaction plate (39) is moved, such as by rotation, to achieve the transfer opening open condition (47), compacted material (8) can pass through the pass-through (71) from the receptacle interior space (25) into the container interior space (60).

Figure 18:
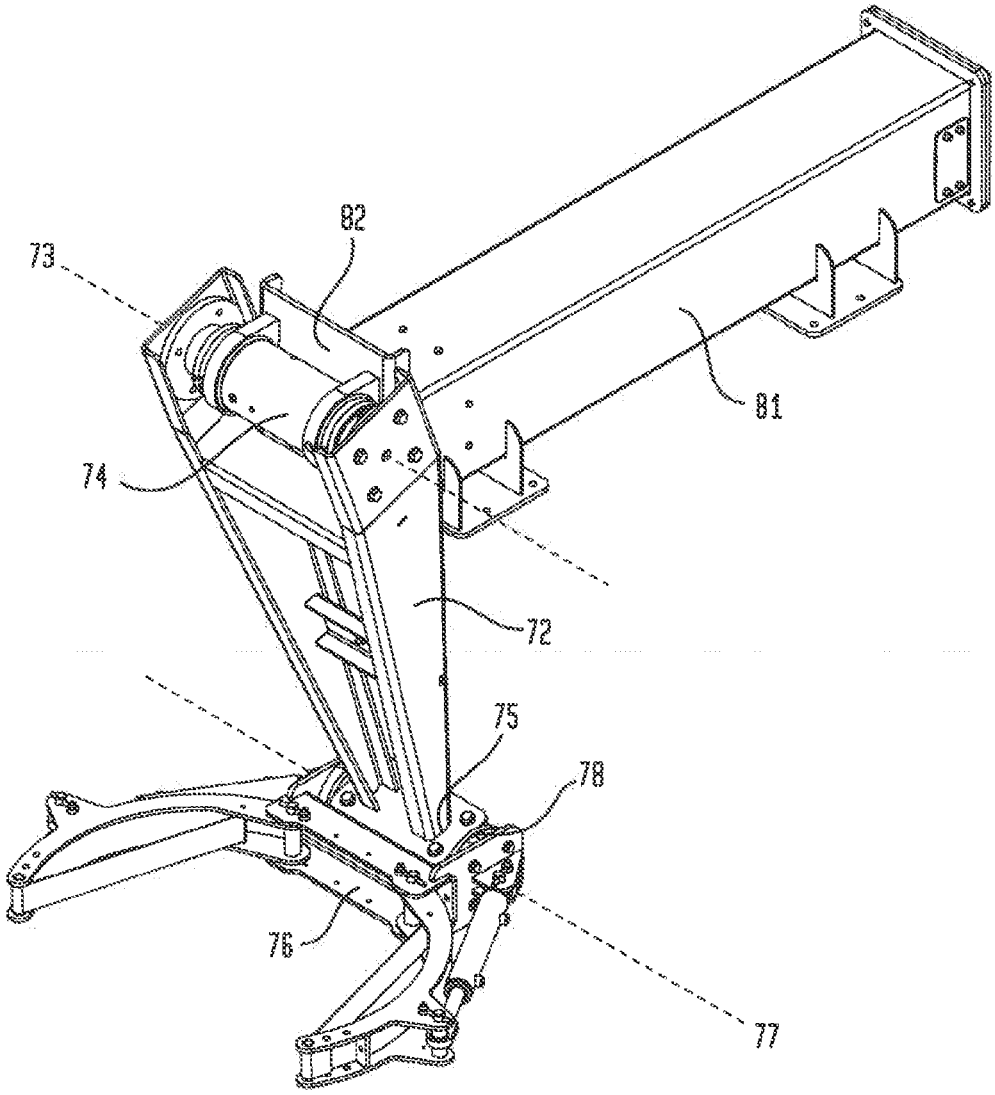
FIG. 18 is a perspective view of a particular embodiment of an extendable arm, a rotatable arm, and a rotatable gripper of the material handling system.

Now referring primarily to FIG. 1 through FIG. 7, and FIG. 18, the material handling system (1) can, but need not necessarily, further include a rotatable arm (72) rotatably disposed proximate the receptacle (4) to allow the rotatable arm (72) to reciprocally rotate about a rotatable arm rotation axis (73) (as shown in the example of FIG. 18). Rotation of the rotatable arm (72) about the rotatable arm rotation axis (73), which can be driven by a rotatable arm rotation actuator (74), moves a rotatable arm first end (75) toward or away from the loading opening (5).

As to particular embodiments, the rotatable arm rotation actuator (74) can be configured as a rotary actuator, which may provide numerous advantages in relation to conventional hydraulic actuators. As but one illustrative example, a rotary actuator may allow a greater rotatable arm rotation arc relative to a conventional hydraulic actuator.

Now referring primarily to FIG. 18, as to particular embodiments, the rotatable arm (72) can, but need not necessarily, further include a rotatable gripper (76) rotatably coupled to the rotatable arm first end (75), whereby the rotatable gripper (76) can rotate about a rotatable gripper rotation axis (77) (as shown in the example of FIG. 18) to facilitate releasably gripping material (2), for example refuse (3) disposed proximate a curb. Rotation of the rotatable gripper (76) about the rotatable gripper rotation axis (77), which can be driven by a rotatable gripper rotation actuator (78), moves the rotatable gripper (76) along a rotatable gripper rotation arc which disposes in generally perpendicular relation to the rotatable gripper rotation axis (77).

As to particular embodiments, the rotatable gripper (76) can have a rotatable gripper rotation arc which is greater than the rotation arc of conventional rotatable grippers of conventional material handling vehicles, such as trash trucks, whereby this greater rotatable gripper rotation arc allows the instant rotatable gripper (76) to be positioned in a numerous and wide variety of positions to grip a numerous and wide variety of material configurations, including as non-limiting examples: generally rigid vessels (79), such as trash cans (80), which contain the material (2); relatively flexible vessels (79), such as trash bags, which contain the material (2); piles of material (2); bundles of material (2); or the like; or combinations thereof. As but one illustrative example, the rotatable gripper rotation arc can be about 240, allowing the rotatable gripper (76) to grip the above-listed material configurations when disposed proximate a curb.

Again referring primarily to FIG. 18, the material handling system (1) can, but need not necessarily, further include an extendable arm (81) disposed proximate the receptacle (4), for example proximate the receptacle bottom portion (19), whereby the extendable arm (81) can reversibly extend laterally outward. The rotatable arm (72) can be rotatably coupled to an extendable arm first end (82), whereby extension of the extendable arm (81) disposes the extendable arm first end (82) and correspondingly, the rotatable arm (72), laterally outward, which may be useful for allowing the rotatable gripper (76) to grip the above-listed material configurations when disposed proximate a curb.

Now referring primarily to FIG. 1 through FIG. 7, as to particular embodiments, the material handling system (1) can be coupled to or mounted on the chassis (27) of a vehicle (28), for example via a base frame (83) which can be coupled in fixed relation to the chassis (27). For example, both the receptacle (4) and the container (9) can be coupled to the base frame (83) to couple the material handling system (1) to the chassis (27).

As to particular embodiments, the material handling system (1) can further include one or more seals or gaskets, which can preclude leakage from the material handling system (1). As but one illustrative example, a neoprene chemical-resistant seal can be disposed proximate all joints of the container (9) to preclude leakage from the container (9) and comply with Environmental Protection Agency (EPA) hazardous spill regulations.

Movement (such as rotation) of components of the material handling system (1) can be executed by a motorized system; a hydraulic system, which can be an electrohydraulic system; a rotary actuator system; or any other conventional system know to one of ordinary skill in the art, which can execute the desired movements.

Execution of the desired movements can be controlled by an operating system (84) having a central processor (85), which can be in operative communication with the motorized system, the hydraulic system, the rotary actuator system, or other conventional system. The operating system (84) can include controls (86) such as a joystick, a bank of switches, a display, or the like, or combinations thereof, which can be located entirely within the cab (68) of the vehicle (28). Accordingly, an operator can control all movements of the material handling system (1) from within the cab (68), thereby eliminating the need for the operator to exit the cab (68) of the vehicle (28) to operate the material handling system (1).

As to particular embodiments, the material handling system (1) can further include one or more sensors which can be coupled to one or more components of the material handling system (1). As illustrative examples, the sensor can be a camera, an inclination sensor, a proximity sensor, or the like, or combinations thereof. As to particular embodiments, the one or more sensors can be in communication with the central processor (85) of the operating system (84), allowing the operator to receive a signal generated by the sensor within the cab (68) of the vehicle (28).

A method of making a particular embodiment of a material handling system (1) can include providing a receptacle (4); disposing a loading opening (5) within the receptacle (4); disposing a transfer opening (6) within the receptacle (4) in adjacent angled relation to the loading opening (5); and rotatably coupling a first compaction plate (7) proximate the receptacle (4) between the loading opening (5) and the transfer opening (6).

The method of making the material handling system (1) can, but need not necessarily, further include coupling a receptacle first end wall (22) between opposing receptacle first and second side walls (20)(21), the receptacle first end wall (22) having a generally concave receptacle first end wall internal surface (23).

The method of making the material handling system (1) can, but need not necessarily, further include disposing the loading opening (5) proximate a receptacle top portion (18) and disposing the transfer opening (6) proximate a receptacle second end (13).

The method of making the material handling system (1) can, but need not necessarily, further include movably disposing a second compaction plate (39) proximate the transfer opening (6). As to particular embodiments, the method can include slidably disposing the second compaction plate (39) proximate the transfer opening (6). As to other particular embodiments, the method can include rotatably coupling the second compaction plate (39) proximate the transfer opening (6).

The method of making the material handling system (1) can, but need not necessarily, further include configuring the second compaction plate (39) to have an immovable condition (50) in which the second compaction plate (39) maintains its position, even upon forcible urging.

The method of making the material handling system (1) can, but need not necessarily, further include disposing a container (9) proximate the transfer opening (6). As to particular embodiments, the method can further include configuring the container (9) to have an adjustable container length (51) disposed between container first and second end walls (52)(53).

The method of making the material handling system (1) can, but need not necessarily, further include movably coupling a container second end wall (53) to the container (9). As to particular embodiments, the method can include rotatably coupling the container second end wall (53) to the container (9).

The method of making the material handling system (1) can, but need not necessarily, further include slidably disposing the container (9) on a chassis (27) of a vehicle (28).

The method of making the material handling system (1) can, but need not necessarily, further include rotatably coupling the container (9) to the chassis (27) of the vehicle (28).

The method of making the material handling system (1) can, but need not necessarily, further include disposing a container first end opening (70) within a container first end wall (52) adjacent the transfer opening (6) to form a pass-through (71) between a receptacle interior space (25) and a container interior space (60).

The method of making the material handling system (1) can, but need not necessarily, further include rotatably disposing a rotatable arm (72) proximate the receptacle (4), whereby rotation of the rotatable arm (72) about a rotatable arm rotation axis (73) moves a rotatable arm first end (75) toward or away from the loading opening (5). As to particular embodiments, the method can further include configuring the rotatable arm (72) to be driven by a rotatable arm rotation actuator (78) configured as a rotary actuator.

The method of making the material handling system (1) can, but need not necessarily, further include rotatably coupling a rotatable gripper (76) to the rotatable arm first end (75).

The method of making the material handling system (1) can, but need not necessarily, further include disposing an extendable arm (81) proximate the receptacle (4), whereby the extendable arm (81) is configured to reversibly extend laterally outward.

The method of making the material handling system (1) can, but need not necessarily, further include rotatably coupling the rotatable arm (72) to an extendable arm first end (82).

Components of the material handling system (1) can be formed from any of a numerous and wide variety of materials, such as rigid materials, substantially inflexible materials, resiliently flexible materials, or the like, or combinations thereof. By way of non-limiting example, the material can be natural or synthetic and can include or consist of: metal, metal sheet, wood, rubber, rubber-like material, plastic, plastic-like material, acrylic, polyamide, polyester, microfiber, polypropylene, polyvinyl chloride-based materials, silicone-based materials, or the like, or combinations thereof.

Components of the material handling system (1) can be made from any of a wide variety of processes depending upon the application, such as press molding, injection molding, fabrication, machining, printing, additive printing, or the like, or combinations thereof, whereby each component can be made as one piece or assembled from a plurality of pieces into the component.

Components of the material handling system (1) can be assembled from a plurality of pieces or coupled to one another by any of a numerous and wide variety of methods of joining materials, which can include conventional methods for fixedly joining materials or methods for removably joining materials, including but not limited to, adhering, fastening, welding, cementing, crimping, fusing, gluing, sealing, taping, or the like.

Now referring primarily to FIG. 19A through FIG. 19E, a method of using the material handling system (1) to handle material (2), such as refuse (3), can include obtaining the material handling system (1); loading the material (2) into the receptacle (4) by passing the material (2) through the loading opening (5); and compacting the material (2) loaded into the receptacle (4) by rotating the first compaction plate (7) to generate compacted material (8).

Now referring primarily to FIG. 19B and. FIG. 19C, the method of using the material handling system (1) to handle material (2), such as refuse (3), can, but need not necessarily, further include releasably gripping the material (2) with a rotatable arm first end (75) of a rotatable arm (72) rotatably disposed proximate the receptacle (4); rotating the rotatable arm (72) toward the loading opening (5) to position the material (2) proximate the loading opening (5); and passing the material (2) through the loading opening (5) and into the receptacle (4). As to particular embodiments, a rotatable gripper (76) rotatably coupled to the rotatable arm first end (75) releasably grips the material (2).

Now referring primarily to FIG. 19E, the method of using the material handling system (1) to handle material (2), such as refuse (3), can, but need not necessarily, further include compacting the material (2) loaded into the receptacle (4) by rotating the first compaction plate (7) toward a second compaction plate (39) in an immovable condition (50), whereby the material (2) is compacted by forcible urging of the first compaction plate (7) upon the material (2) disposed between the first and second compaction plates (7)(39), to generate the compacted material (8).

Now referring primarily to FIG. 19F, the method of using the material handling system (1) to handle material (2), such as refuse (3), can, but need not necessarily, further include transferring the compacted material (8) from the receptacle (4) into a container (9) disposed proximate the transfer opening (6) by passing the compacted material (8) through a pass-through (71) formed from the transfer opening (6) and a container first end opening (70) disposed adjacent the transfer opening (6). As to particular embodiments, rotating the first compaction plate (7) can forcibly urge the compacted material (8) through the pass-through (71).

Now referring primarily to FIG. 19G, the method of using the material handling system (1) to handle material (2), such as refuse (3), can, but need not necessarily, further include rearwardly sliding the container (9) to facilitate egression of the compacted material (8) from the container (9) through a container second end opening (63).

Now referring primarily to FIG. 19H and FIG. 19I, the method of using the material handling system (1) to handle material (2), such as refuse (3), can, but need not necessarily, further include rotating the container (9) to facilitate egression of the compacted material (8) from the container (9) through a container second end opening (63).

Now referring primarily to FIG. 19I, the method of using the material handling system (1) to handle material (2), such as refuse (3), can, but need not necessarily, further include rotating the container second end wall (53) to facilitate egression of the compacted material (8) from the container (9) through a container second end opening (63).

The method of using the material handling system (1) to handle material (2), such as refuse (3), can, but need not necessarily, further include controlling all movements of the material handling system (1) from within a cab (68) of a vehicle (28) to which the material handling system (1) couples. Accordingly, an operator can control all movements of the material handling system (1) without exiting from the cab (68) of the vehicle (28).

As can be easily understood from the foregoing, the basic concepts of the present invention may be embodied in a variety of ways. The invention involves numerous and varied embodiments of a material handling system and methods for making and using such material handling systems including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "rotator" should be understood to encompass disclosure of the act of "rotating"—whether explicitly discussed or not—and, conversely, were there effectively disclosure of the act of "rotating", such a disclosure should be understood to encompass disclosure of a "rotator" and even a "means for rotating". Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the material handling systems herein disclosed and described, ii) the related methods disclosed and described, iii) equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A material handling system comprising:

a receptacle;

a loading opening disposed within said receptacle defined by an open receptacle top portion;

a transfer opening disposed within said receptacle defined by an open receptacle second end, said transfer opening in adjacent angled relation to said loading opening;

a first compaction plate rotatably coupled proximate said receptacle between said loading opening and said transfer opening; and a second compaction plate movably disposed proximate said transfer opening;

wherein said second compaction plate is rotatably coupled proximate said transfer opening between opposing receptacle first and second side walls.

2. The material handling system of claim 1, wherein said receptacle comprises a receptacle first end wall coupled between opposing receptacle first and second side walls, said receptacle first end wall having a generally concave receptacle first end wall internal surface.

3. The material handling system of claim 2, wherein said loading opening is disposed proximate a receptacle top portion and wherein said transfer opening is disposed proximate a receptacle second end.

4. The material handling system of claim 1, wherein a loading opening closed condition is achieved by rotating said first compaction plate to overlay said loading opening such that passage through said loading opening is precluded by said first compaction plate.

5. The material handling system of claim 4, wherein a loading opening open condition is achieved by rotating said first compaction plate to dispose said first compaction plate in angled relation to said loading opening such that material can pass through said loading opening.

6. The material handling system of claim 1, wherein a transfer opening closed condition is achieved by rotating said second compaction plate to overlay said transfer opening such that passage through said transfer opening is precluded by said second compaction plate.

7. The material handling system of claim 6, wherein a transfer opening open condition is achieved by rotating said second compaction plate to dispose said second compaction plate in angled relation to said transfer opening such that material can pass through said transfer opening.

8. The material handling system of claim 7, wherein when said second compaction plate overlays said transfer opening to achieve said transfer opening closed condition, said second compaction plate is capable of being in an immovable condition in which said second compaction plate maintains its position, even upon forcible urging.

9. The material handling system of claim 8, wherein upon rotation of said first compaction plate about said first compaction plate rotation axis toward said second compaction plate in said immovable condition, said material disposed between said first and second compaction plates is compacted to generate compacted material.

10. The material handling system of claim 8, further comprising a container disposed proximate said transfer opening.

11. The material handling system of claim 10, wherein said container comprises a container second end wall which said container second end wall is rotatably coupled to said container.

12. The material handling system of claim 11, wherein said container is slidably disposed on a chassis of a vehicle.

13. The material handling system of claim 12, wherein said container is rotatably coupled to said chassis of said vehicle.

14. The material handling system of claim 10, wherein said container comprises a container first end opening disposed within a container first end wall, and wherein said container first end opening disposes adjacent said transfer opening to form a pass-through between a receptacle interior space and a container interior space.

15. The material handling system of claim 1, further comprising a rotatable arm rotatably disposed proximate said receptacle, wherein rotation of said rotatable arm about a rotatable aim rotation axis moves a rotatable aim first end toward or away from said loading opening.

16. The material handling system of claim 15, wherein said rotatable arm further comprises a rotatable gripper rotatably coupled to said rotatable arm first end.

17. The material handling system of claim 15 further comprising an extendable arm disposed proximate said receptacle, wherein said extendable arm is configured to reversibly extend laterally outward.

18. The material handling system of claim 17, wherein said rotatable arm rotatably couples to an extendable arm first end.

19. The material handling system of claim 1, wherein said adjacent angled relation comprises substantially perpendicular relation.

* * * * *